US007314013B2

(12) United States Patent
Fujihara

(10) Patent No.: US 7,314,013 B2
(45) Date of Patent: Jan. 1, 2008

(54) SEWING MACHINE

(75) Inventor: Shinya Fujihara, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 11/507,522

(22) Filed: Aug. 22, 2006

(65) Prior Publication Data

US 2007/0044698 A1 Mar. 1, 2007

(30) Foreign Application Priority Data

Aug. 24, 2005 (JP) ..... 2005-242603

(51) Int. Cl.
*D05B 87/02* (2006.01)
*D05B 49/00* (2006.01)

(52) U.S. Cl. ..... 112/225

(58) Field of Classification Search ..... 112/225, 112/278, 241, 243, 254, 302, 259; 223/99
See application file for complete search history.

(56) References Cited

U.S. PATENT DOCUMENTS 3,485,194 A 12/1969 Eguchi
4,185,574 A * 1/1980 Totino et al. ..... 112/225
4,241,678 A * 12/1980 Tullman ..... 112/225
4,461,409 A 7/1984 Biemans
4,651,660 A * 3/1987 Oshima et al. ..... 112/225
5,088,426 A * 2/1992 Ogawa ..... 112/225
7,121,217 B2 * 10/2006 Mizuno et al. ..... 112/225
7,178,473 B2 * 2/2007 Mizuno et al. ..... 112/225
7,191,719 B2 * 3/2007 Hayashi et al. ..... 112/225
2002/0073904 A1 6/2002 Sano et al.
2005/0268830 A1 12/2005 Mizuno et al.

FOREIGN PATENT DOCUMENTS

EP 1 264 923 A1 12/2002
JP A-1-113092 5/1989
JP B2 2-14866 4/1990
JP A 8-173678 7/1996
JP A 2002/346261 12/2002

* cited by examiner

*Primary Examiner*—Ismael Izaguirre
(74) *Attorney, Agent, or Firm*—Oliff & Berridge, PLC

(57) ABSTRACT

A sewing machine including an automatic threading device that automatically threads at least one of a plurality of threading portions including the thread take-up with a needle thread drawn from a thread source, the sewing machine comprising a first thread guide path for a first threading route that enables threading of the needle thread by the automatic threading device; a second thread guide path for a second threading route that enables manual threading of the needle thread; a movable member that forms a movable thread guide path switchable between a first position enabling threading of the thread take-up and a second position disabling threading of the thread take-up, and a switch mechanism that switches the movable member so as to switch the movable thread guide path between the first and the second positions.

8 Claims, 34 Drawing Sheets

SEWING MACHINE

This application is based upon and claims the benefit of priority from the prior Japanese Patent Application 2005-242603, filed on, Aug. 4, 2005 the entire contents of which are incorporated herein by reference.

FIELD

The present invention is directed to a sewing machine provided with an automatic threading device and particularly to a sewing machine capable of also manually threading a plurality of threading portions with a needle thread. The automatic threading device of the sewing machine draws the needle thread from a thread source and sets the drawn needle thread in a threading route in advance so that at least one of the threading portions can be threaded automatically.

BACKGROUND

In a conventional sewing machine, a plurality of threading portions such as a thread tension regulator, check spring and thread take-up is threaded sequentially in a predetermined route with a needle thread supplied from the thread spool. The needle thread ultimately threads an eye of a sewing needle attached to a needle bar, whereafter the needle thread is placed in condition to carry out a sewing operation. Such sewing machine is generally threaded manually by the user, whereby the plurality of threading portions is threaded with the needle thread.

In contrast, a sewing machine provided with an automatic threading device that sequentially threads the plurality of threading portions is also available nowadays. In such a sewing machine, the needle thread supplied from the thread spool is set in a predetermined threading route in advance. Then, the needle thread set in the threading route is caught by a hook and carried to the plurality of threading portions to thread the same.

For example, an automatic threading device disclosed in JP-B-H02-14866 (hereinafter referred to as patent reference 1) includes a thread holding member; an operating lever having the thread holding member pivoted to the distal end thereof and a base end thereof pivoted to a sewing machine frame; a thread carrier member having a lock member in the distal end thereof and having a base end thereof pivoted to a sewing machine frame; and an operating portion. A thread tension regulator is provided in the upper portion of a sewing machine arm. The automatic threading device threads the threading portions with a needle thread as follows. First, threading portions in the extremity of a thread take-up, the thread holding member, and the lock member of the thread carrier member are arranged to project above the sewing machine arm by the user. Then, a thread tension regulator, the threading portion of the thread take-up, and the thread holding member are threaded sequentially with the needle thread supplied from the thread spool to place the sewing machine in condition for a sewing operation.

By operating the operating portion from this state, the operating lever and the thread carrier member are rotated, whereby the thread holding member holding the needle thread is lowered to the proximity of the sewing needle. Then, a threading hook of the automatic threading device threads the eye of the sewing needle with the needle thread. Also, the lock portion of the thread carrier member is lowered, engaging the needle thread therewith. The needle thread is thereafter brought into engagement with a check spring disposed inside the sewing machine arm. In instances where automatic threading of plurality of threading portions is not possible due to failure of the automatic threading device, manual threading is required on the part of the user.

However, the patent reference 1 does not disclose any threading technique allowing manual threading of the plurality of threading portions with the needle thread. More specifically, the type of sewing machine disclosed in patent reference 1 has threading portions such as the check spring, the thread take-up, and the thread tension discs housed inside the sewing machine; hence, substantial effort is required on the part of the user to manually thread the threading portions with the needle thread. One possible solution to such problem may be removing the sewing machine cover to provide access to the threading portions. More specifically, the front cover covering the threading portions such as the check spring, the thread take-up and the thread tension discs may be removed to enable manual threading of the same.

However, the sewing machine having the automatic threading device disclosed in patent reference 1 is not designed to manually thread the plurality of threading portions with the needle thread. Thus, if the automatic threading device breaks down, it becomes extremely difficult to thread the plurality of threading portions. Thus, the ease and reliability of threading the plurality of threading portions is suspended until the automatic threading device is repaired, impairing the quality of sewing work.

In view of the above problem, the sewing machine covers that cover the front side of the check spring, the thread take-up, and the thread tension discs may be removed to enable manual threading of the same. However, manual threading requires time consuming user intervention such as detachment and reattachment of the covers. Also, removing the covers does not guarantee easy and reliable threading of the plurality of threading portions. Moreover, removing the covers and activating the exposed thread take-up and needle bar may have unexpected negative impact on the sewing process.

SUMMARY

Therefore, an object of the present disclosure is to provide a sewing machine capable of automatic needle thread threading by using an automatic threading device and further capable of easy and reliable manual needle thread threading without using the automatic threading device.

The sewing machine of the present invention includes a vertically reciprocable needle bar; a vertically oscillatable thread take-up; a thread source supplying a needle thread to a sewing needle attached to the needle bar; an automatic threading device that automatically threads at least one of a plurality of threading portions including the thread take-up with the needle thread drawn from the thread source; a first thread guide path for a first threading route that enables threading of the needle thread drawn from the thread source by the automatic threading device and a second thread guide path for a second threading route that enables manual threading of the needle thread drawn from the thread source. The sewing machine further includes a movable member forming a movable thread guide path switchable between a first position and a second position, the first position defining a movable thread guide path for a part of the first threading route that enables threading of the thread take-up and the second position defining a movable thread guide path for a part of the second threading route that disables threading of the thread take-up; and a switch mechanism that switches the movable member so as to switch the movable thread guide path between the first position and the second position.

According to the above construction, when the movable member is switched to a first-position corresponding position by the switch mechanism, since the movable thread guide path is switched to the first position, the needle thread is set to the first threading route by the first thread guide path. Thus, at least the thread take-up is threaded with the needle thread via the automatic threading device. On the other hand, when the movable member is switched to a second-position corresponding position by the switch mechanism, the movable thread guide path is switched to the second position. Thus, when the second threading route is manually threaded with the needle thread via the second thread guide path, the thread take-up is not engaged with the needle thread drawn from the thread source, but instead, the thread tension regulator and the check spring are engaged with the needle thread prior to the thread take-up. The plurality of threading portions including the thread take-up is threaded sequentially thereafter.

That is, the plurality of thread portions such as the thread tension regulator, the check spring, and the thread take-up can be threaded sequentially with the needle thread drawn from the thread source in easy and reliable manner without having to initially engage the needle thread 10 with the thread take-up. Thus, even in case the automatic threading device breaks down, sewing work is not affected since the plurality of threading portions can be manually threaded with the needle thread in the proper threading sequence.

In a preferred aspect, the movable member comprises a first and a second movable member each supported slidably between the first-position corresponding position that corresponds to the first position and the second-position corresponding position that corresponds to the second position. The first and the second movable members are disposed so as to define the movable thread guide path in condition to accommodate the needle thread. Thus, the movable thread guide path is rendered switchable between the first position and the second position.

Further, the switch mechanism preferably comprises a first drive unit driving the sliding movement of the first movable member, a first detection unit that detects the movement of the first movable member and a second drive unit driving the sliding movement of the second movable member based on the detection made by the first detection unit. More preferably, the switch mechanism further comprises a second detection unit that detects the start of manual threading triggered by the needle thread passing through the movable thread guide path positioned in the second position. The first and the second drive units are driven so as to slide the first and the second movable members from the second-position corresponding position to the first-position corresponding position base on the detection made by the second detection unit.

The first drive unit preferably drives the first movable member to slide in conjunction with the lifting operation of a presser foot lifting lever that vertically moves the presser bar. It is even more preferable to employ an electrical actuator for the second drive unit.

BRIEF DESCRIPTION OF THE DRAWINGS

Other objects, features and advantages of the present disclosure will become clear upon reviewing the following description of the illustrative aspects with reference to the accompanying drawings, in which.

DETAILED DESCRIPTION OF THE PREFERRED EMBODIMENT

Figure 1:
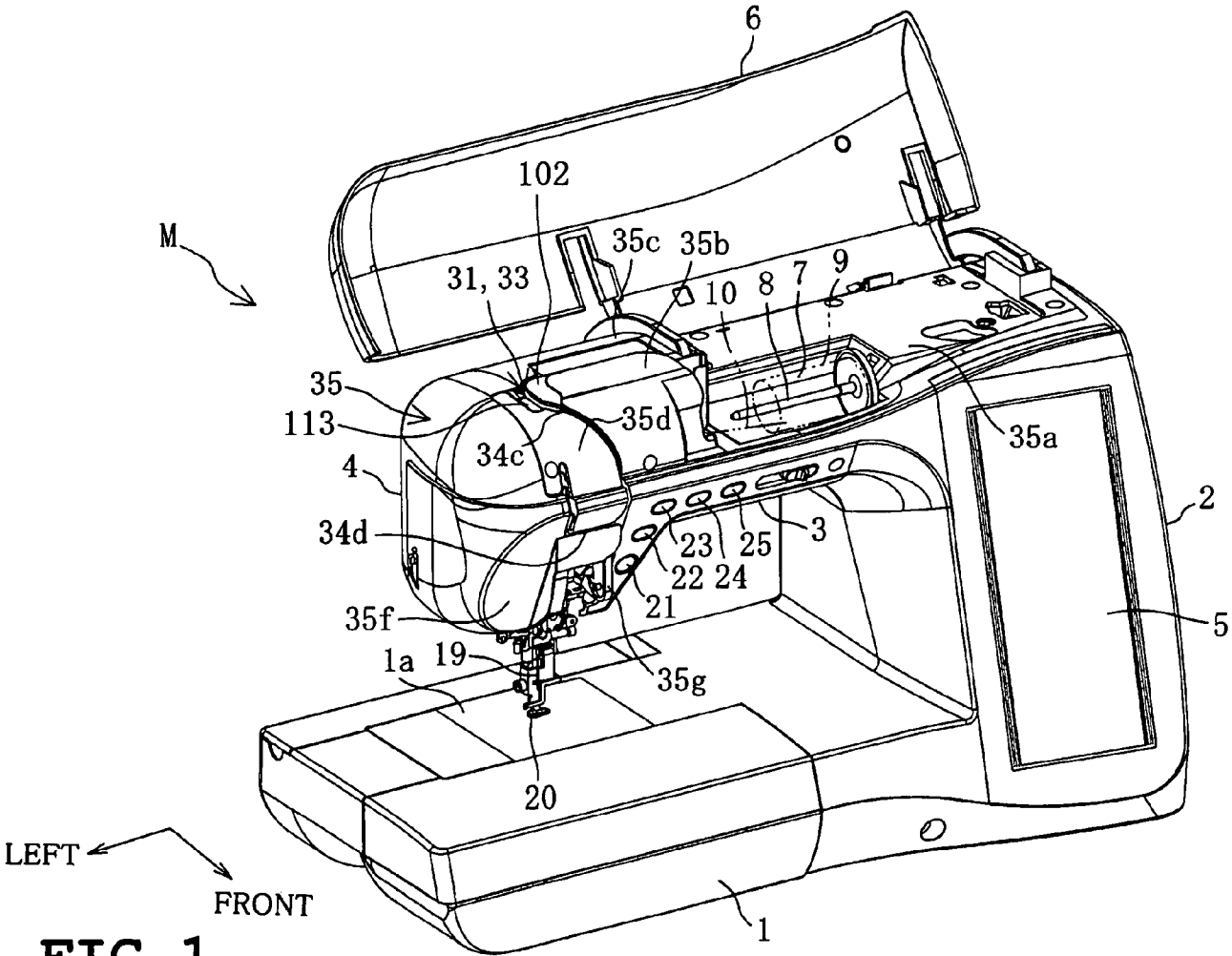
FIG. 1 is a perspective view of a sewing machine taken from the upper oblique direction.

Referring to FIGS. 1 to 4, a sewing machine M includes a bed 1, a foot 2 extending upright in the right side of the bed 1, an arm 3 extending leftward from the upper portion of the foot 2 so as to confront the bed 1, and a head 4 provided on the left end of the arm 4. Provided on the bed 1 are a needle plate 1*a* and a hook mechanism (not shown) provided thereunder. A bobbin having a bobbin thread wound thereto is detachably attached to the hook mechanism. A vertically oriented liquid crystal display 5 is provided in the front face of the foot 2.

The entire upper side of the arm 3 is covered by an openable cover 6. The openable cover 6 is pivoted openably to the upper rear end of the arm 3 by a laterally oriented pivot shaft. A thread storing recess 7, defined in a cover 35*a* inside the arm 3, is covered by the openable cover 6. The thread spool 9 serving as a thread source is mounted on a spool pin 8 in the thread storing recess 7. A plurality of threading portions such as a thread tension regulator 14, check spring 15, and a thread take-up 13 is threaded sequentially with a needle thread 10 drawn from the spool pin 9 whereafter the needle thread 10 is ultimately supplied to a sewing needle 19 attached to a lower end of the needle bar 11 (refer to FIGS. 19A and 20A).

Figure 5:
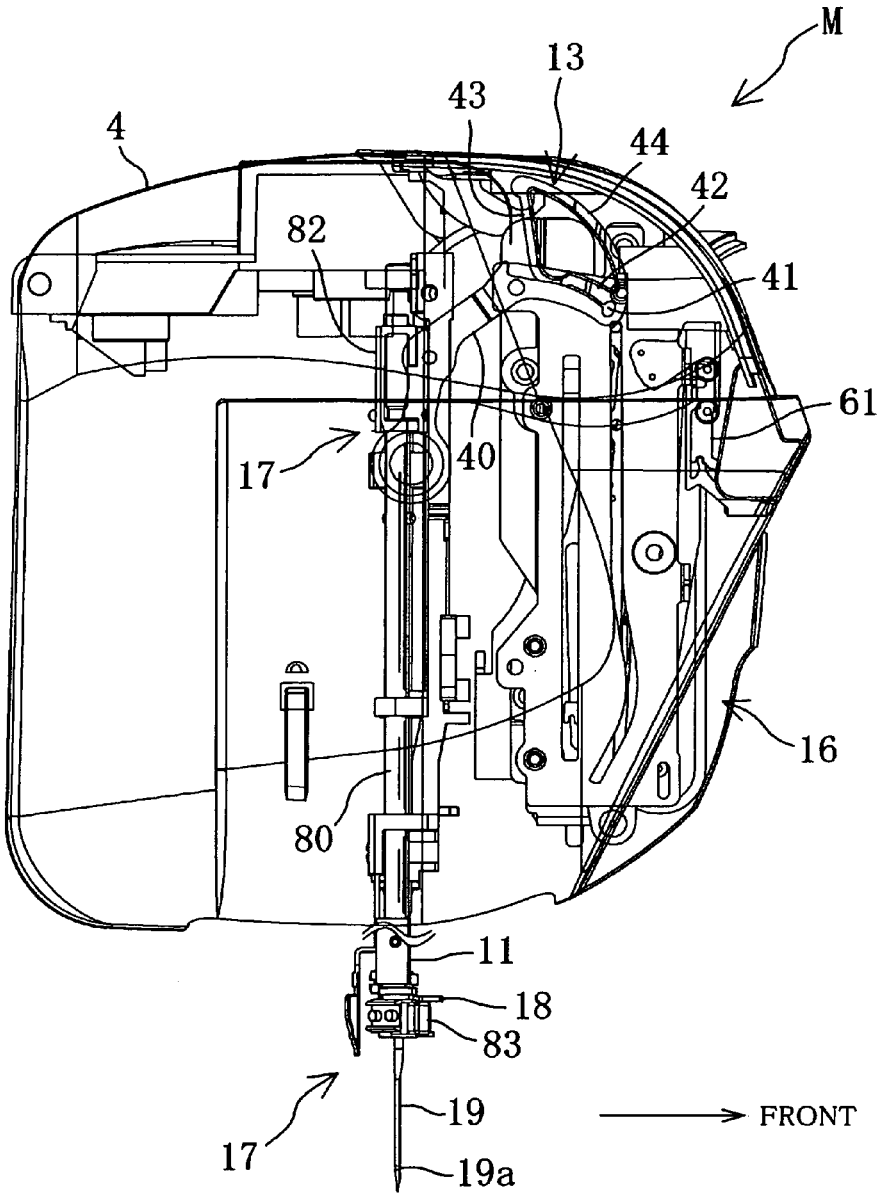
FIG. 5 is a transparent left side view of the sewing machine (capable of being threaded automatically)
Figure 6:
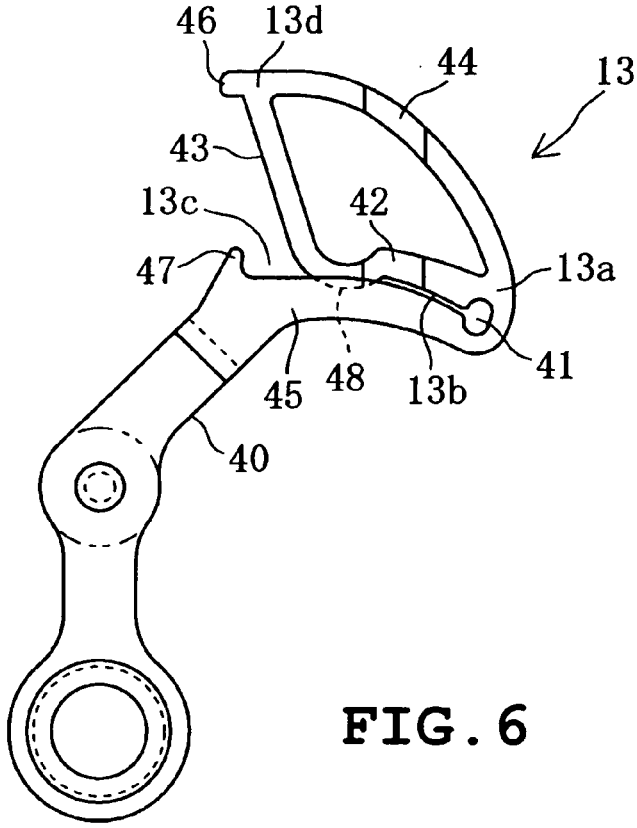
FIG. 6 is a left side view of a thread take-up.
Figure 7:
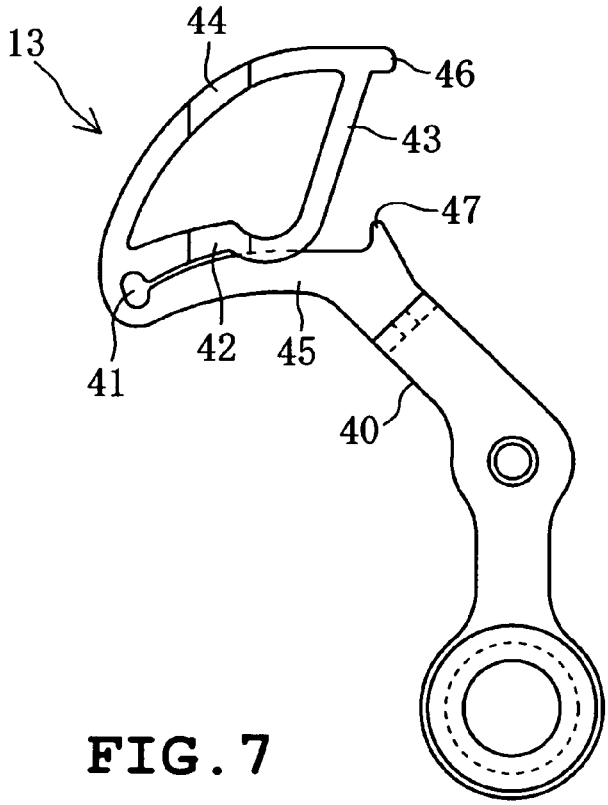
FIG. 7 is a right side view of the thread take-up.
Figure 8:
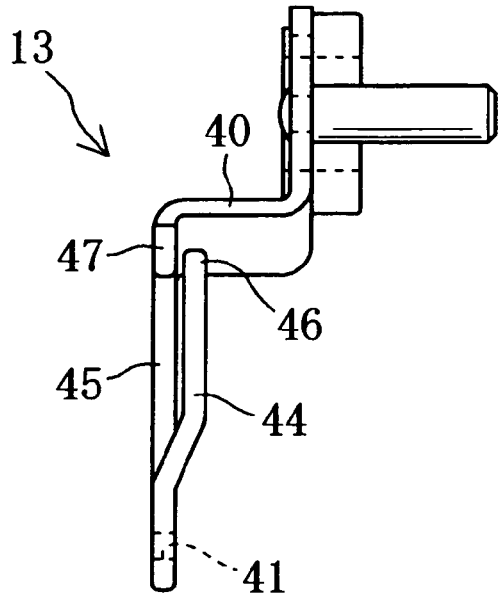
FIG. 8 is a plan view of the thread take-up.
Figure 9:
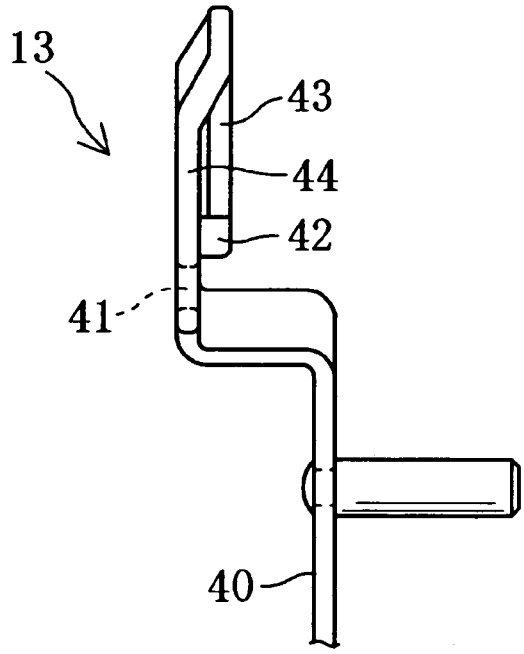
FIG. 9 is a front view of the thread take-up.
Figure 11:
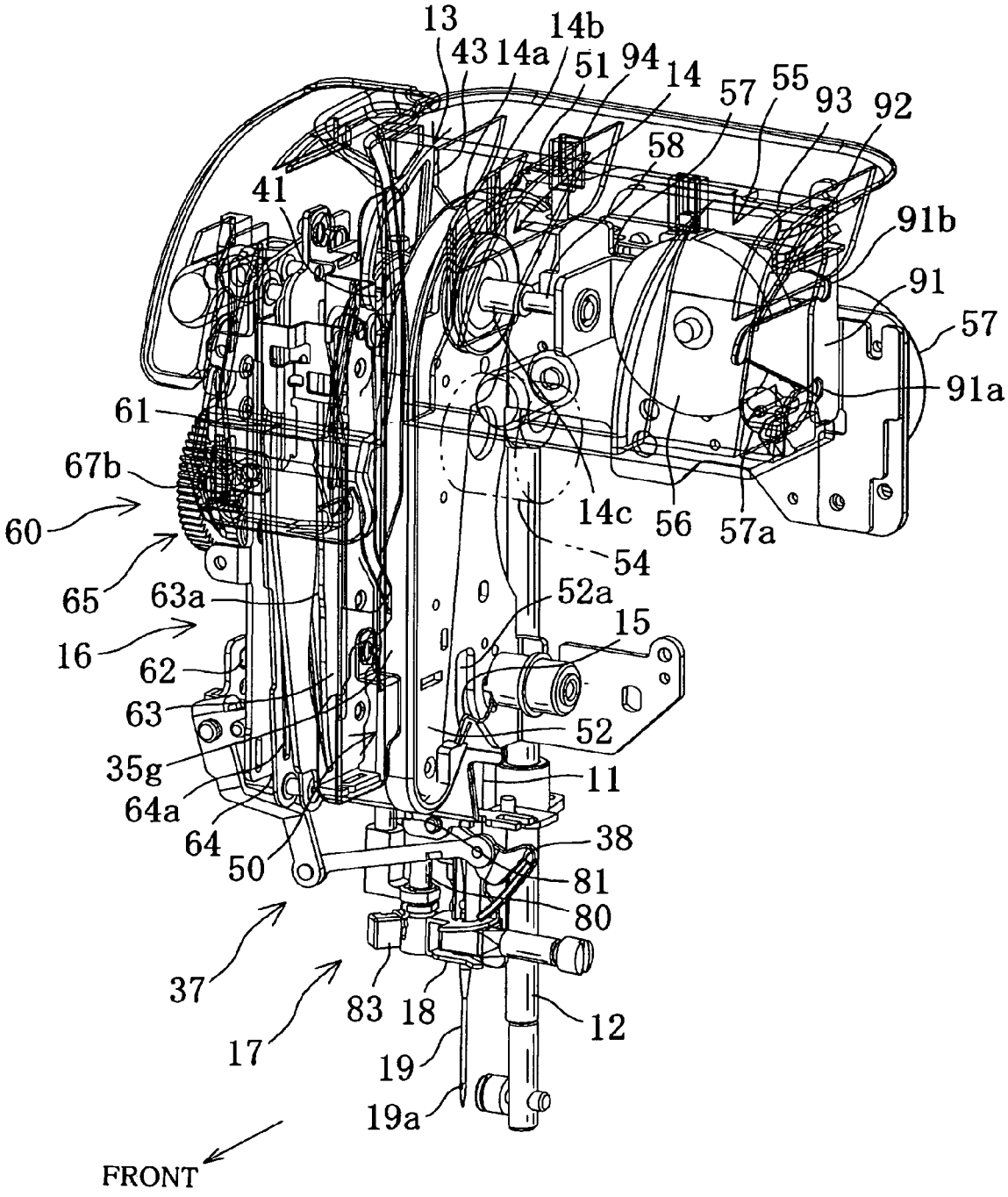
FIG. 11 is a perspective view of an automatic threading device and an automatic needle threading device taken from an upper right direction.
Figure 12:
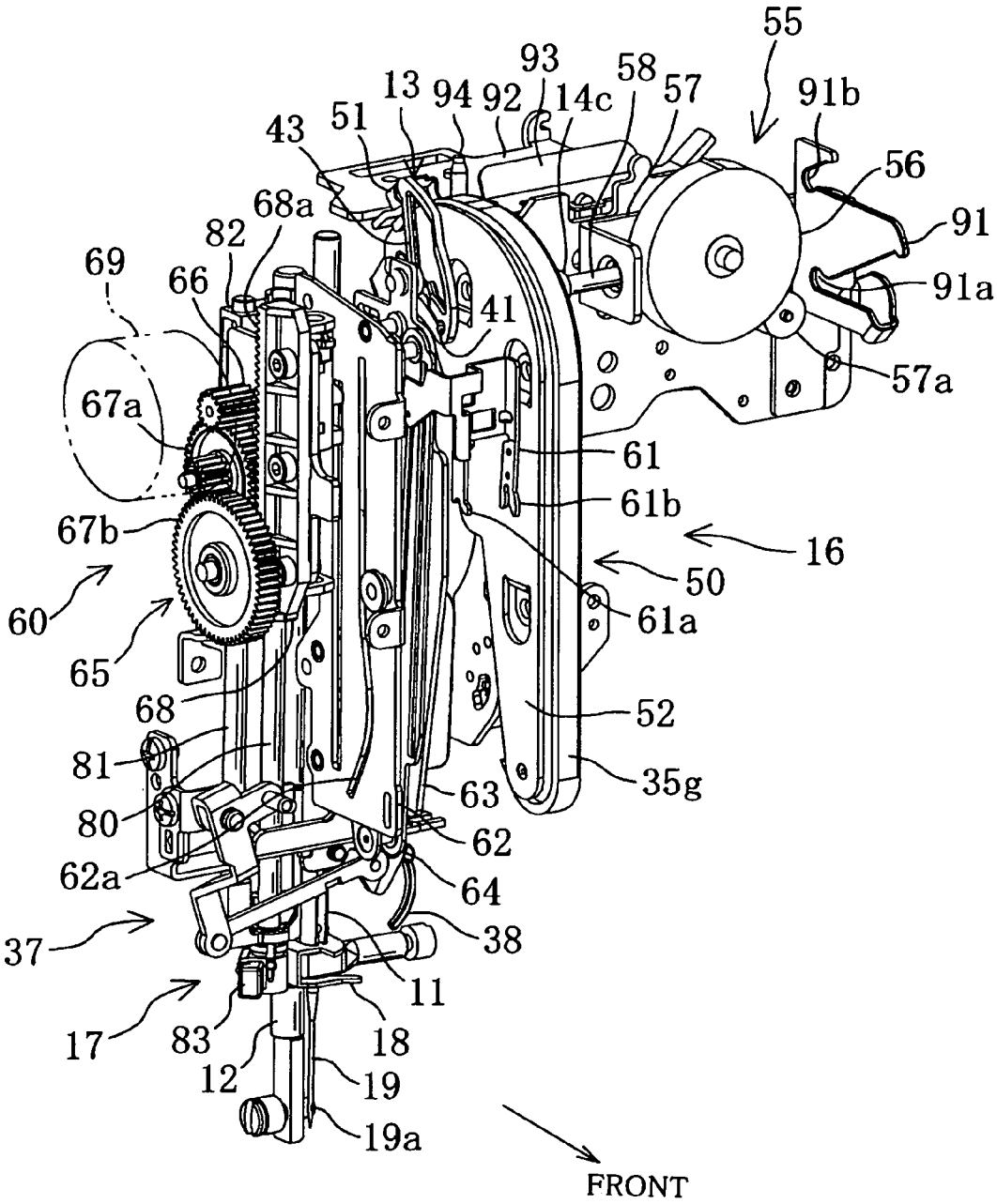
FIG. 12 is a perspective view of the automatic threading device and the automatic needle threading device taken from an upper left direction.

Referring to FIGS. 5, 11 and 12, the head 4 includes the needle bar 11, presser bar 12, thread take-up 13, thread tension regulator 14, check spring 15, automatic threading device 16, and automatic needle threading device 17. The needle bar 11 is supported movably in a vertically reciprocating manner by the sewing machine frame, and a needle bar thread guide 18 and the sewing needle 19 are mounted on the lower end of the needle bar 11. The needle bar 11 is driven in the vertical direction by a sewing machine drive mechanism (not shown) comprising a sewing machine motor.

The presser bar 12 is supported vertically movably by the sewing machine frame and a presser foot 20 (refer to FIGS. 1 and 2) is attached to the lower end of the presser bar 12. As will be described later, the user can manually operate the presser bar 12 between the lifted position and the lowered position by a presser foot lifting lever 77. The presser bar 12 can also be driven between the lifted position and the lowered position by a presser bar lifting mechanism 70 comprising a presser foot lifting pulse motor 73.

Figure 2:
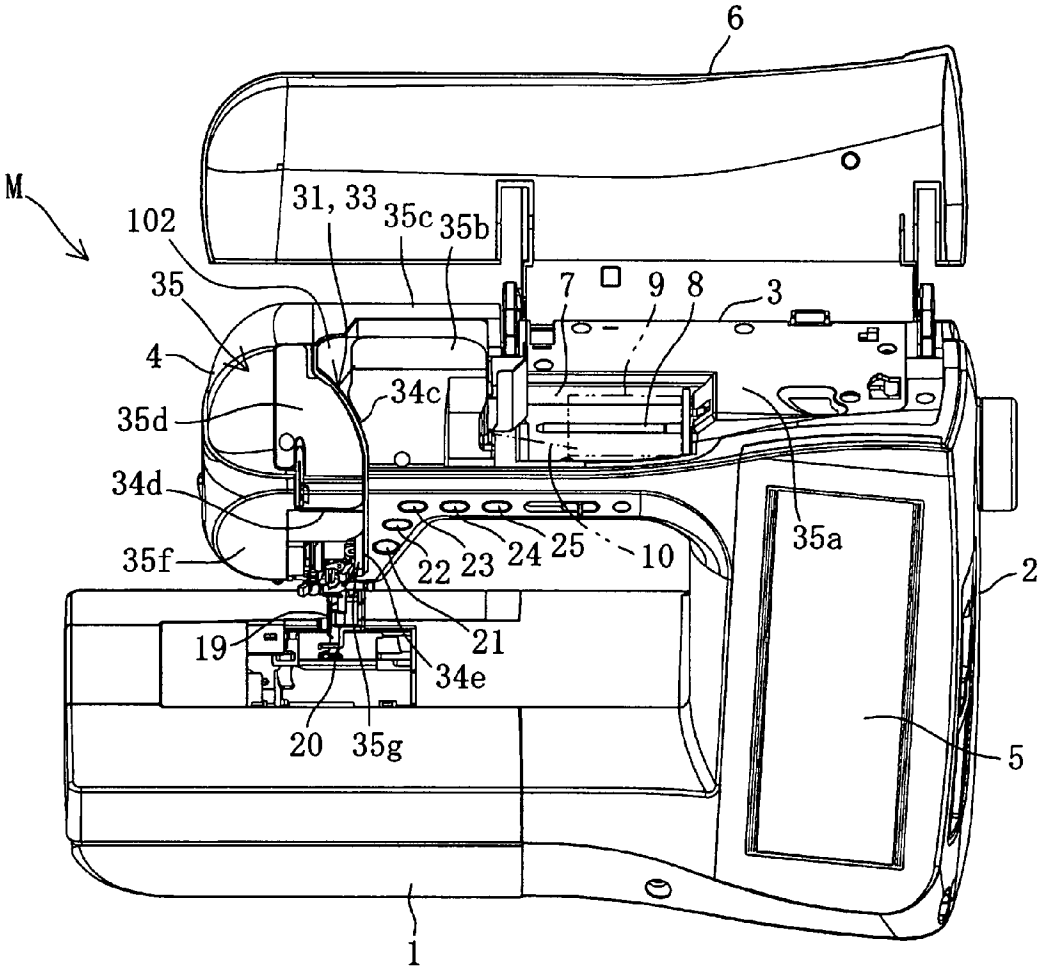
FIG. 2 is a perspective view taken from the upper side of the sewing machine.
Figure 3:
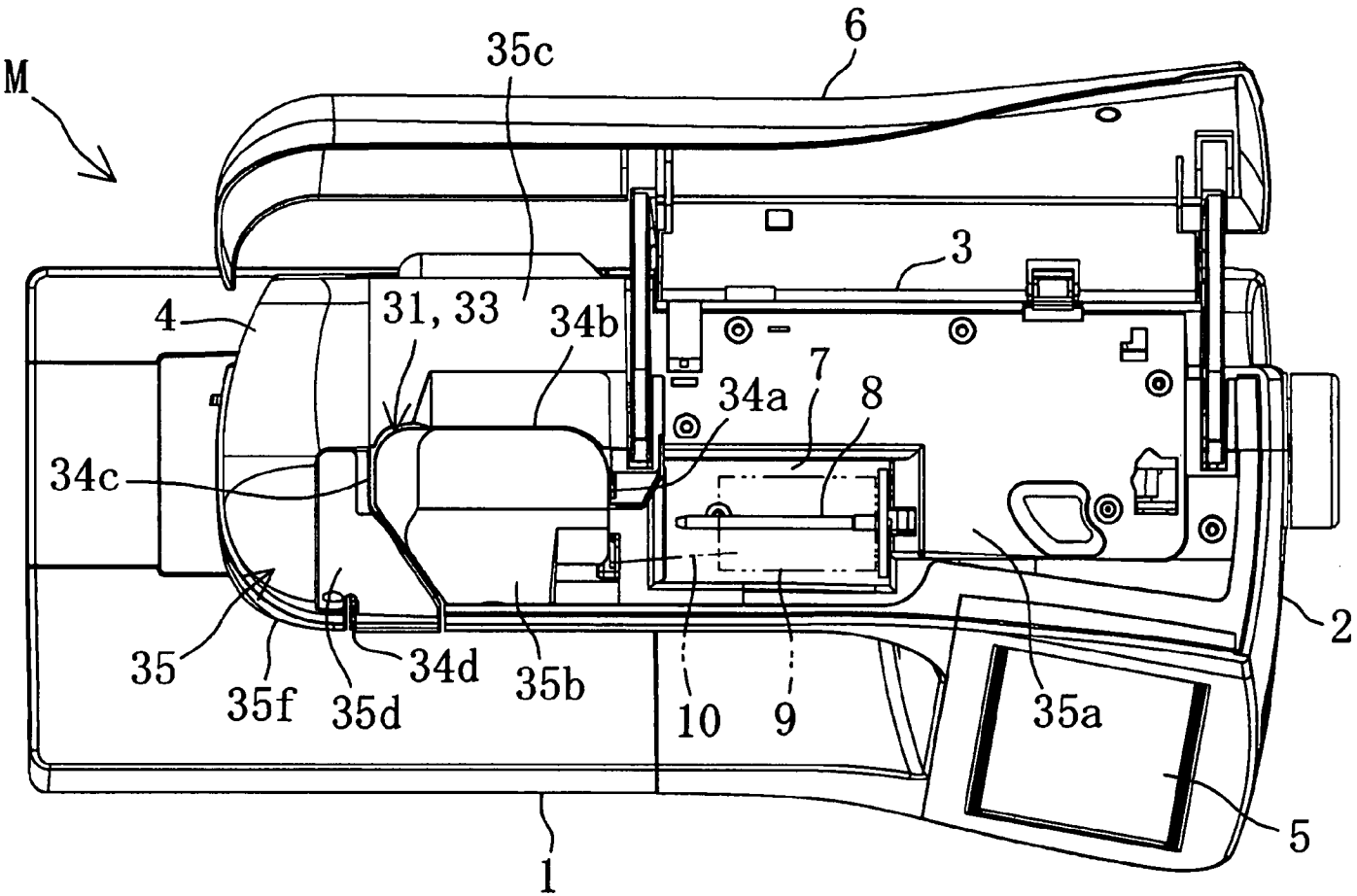
FIG. 3 is a plan view of the sewing machine.
Figure 4:
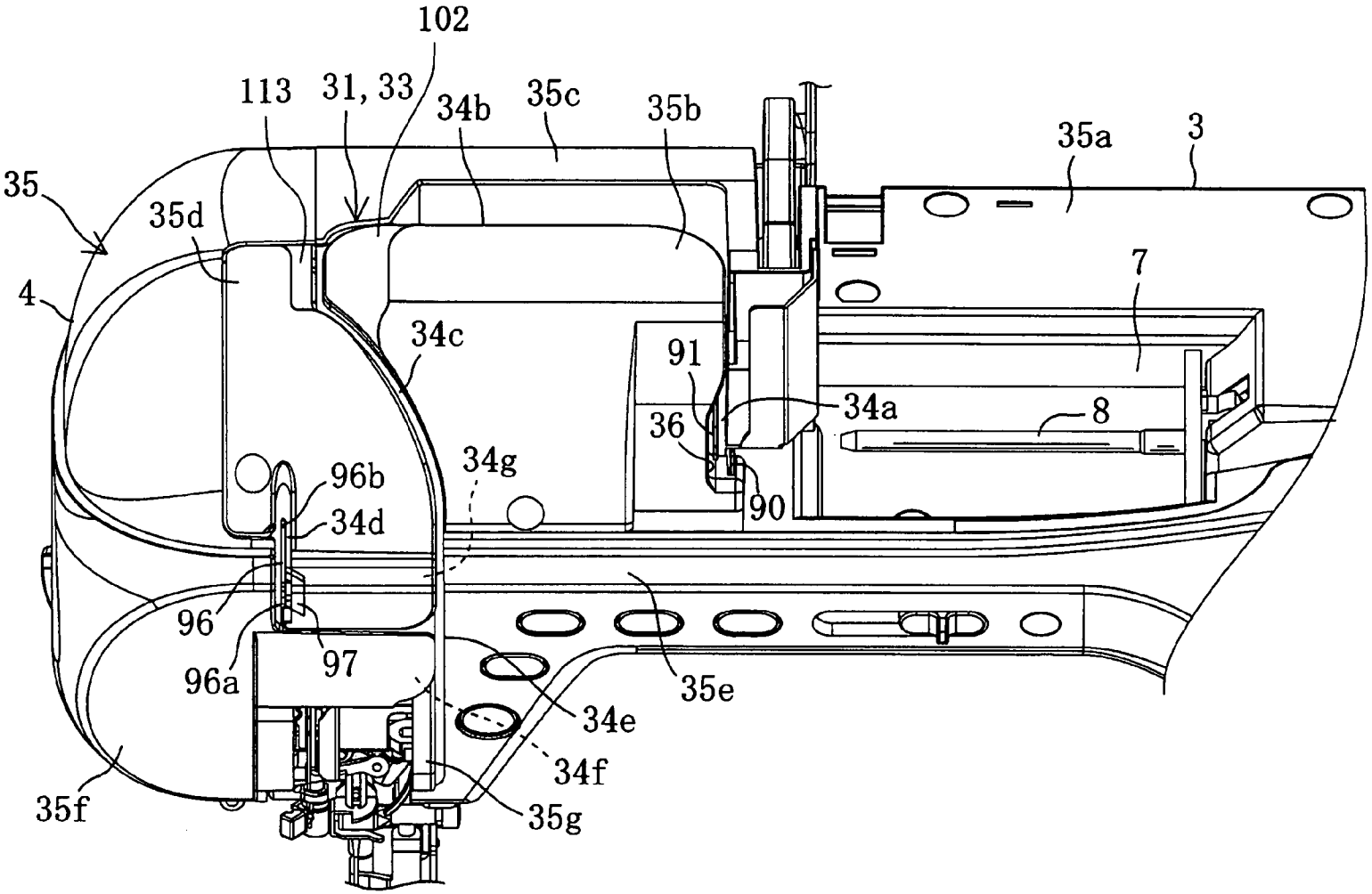
FIG. 4 is an exploded view of the main portion of FIG. 2.

Referring to FIGS. 1, 2, and 4, provided on the front face of the arm 3 are sewing start switch 21, sewing end switch 22, automatic threading preparation switch 23, automatic threading start switch 25, and the like.

Referring to FIGS. 5, 11, and 12, the thread take-up 13 is disposed in the upper portion of the front side of the needle bar 11. The base end of the thread take-up 13 is rotatably pivoted to the sewing machine frame about a laterally oriented shaft. As can be seen in FIGS. 5 to 9, the thread take-up 13 is formed substantially in a reversed V-shape in side view and is in a crank-form in front view. The thread take-up is vertically oscillated in synchronism with the needle bar 11 by a sewing machine drive mechanism not shown.

As shown in FIGS. 6 to 9, the thread take-up 13 is integrally provided with an oscillating thread take-up main body 40, a thread receiving portion 45 defined in a continuous plane with the thread take-up main body 40, a threading portion 41 in consistent engagement with the needle thread 10 during the sewing operation, a thread introducing portion 42 that introduces the needle thread 10 to the threading portion 41, and a thread guide 43 that guides the needle thread 10 to the thread introducing portion 42.

A release guide 44 in a curved profile is formed to connect the threading portion 41 and the thread guide portion 43. The release guide 44 rearwardly guides the needle thread 10 along the right side of the release guide 44 when the thread take-up 13 is manually threaded with the needle thread 10 via a first threading route after the check spring 15 is threaded via the second threading route.

The threading portion 41 comprises a thread hole in a small oval-form defined in a thread take-up distal end 13*a*. The threading portion 41 is connected to a thread guide path 13*b* which is a slit defined by a thread receiving portion 45, that interposes the thread take-up main body 40 and the thread take-up distal end 13*a*, and the thread introducing portion 42. Thus, the needle thread 10 supplied to the thread introducing portion 42 is introduced to the threading portion 41 via the thread guide path 13*b*.

The thread guide 43 is a linear guide portion having a length substantially the same as the length from the opening 13*c* serving as an opened end of the thread guide path 13*b* to the enclosed end of the thread guide path 13*b*. The thread guide 43 defines an angle of approximately 120° relative to the thread receiving portion 45. A first locking portion 46 is formed on an upper end 13*d* of the thread guide 43. The first stopper 46 stops the needle thread 10 so that the needle thread 10 engaged with the thread guide 43 is prevented from upward disengagement.

Also, a second thread stopper 47 is formed on the base end of the thread receiving portion 45. The second thread stopper 47 stops the needle thread 10 so that the needle thread 10 received by the thread receiving portion 45 is prevented from being removed in the direction of the thread take-up main body 40. Also, a projection 48 projecting below the thread receiving portion 45 is formed in a connecting portion between the thread introducing portion 42 and the thread guide 43. The projection 48, when viewed from the side, overlaps with the thread receiving portion 45. The projection 48 prevents the needle thread 10 introduced to the threading portion 41 from slipping off via the thread guide path 13*b*.

Referring to FIG. 11, the thread tension regulator 14 has a pair of thread tension discs 14*a* and 14*b* laterally disposed relative to one another and is placed in the right side of the thread take-up 13; in other words, in the thread spool 9 side. The pair of thread tension discs 14*a* and 14*b* is mounted on the upper end of a first guide frame 52 via a laterally oriented thread tension shaft 14*c*.

Figure 10:
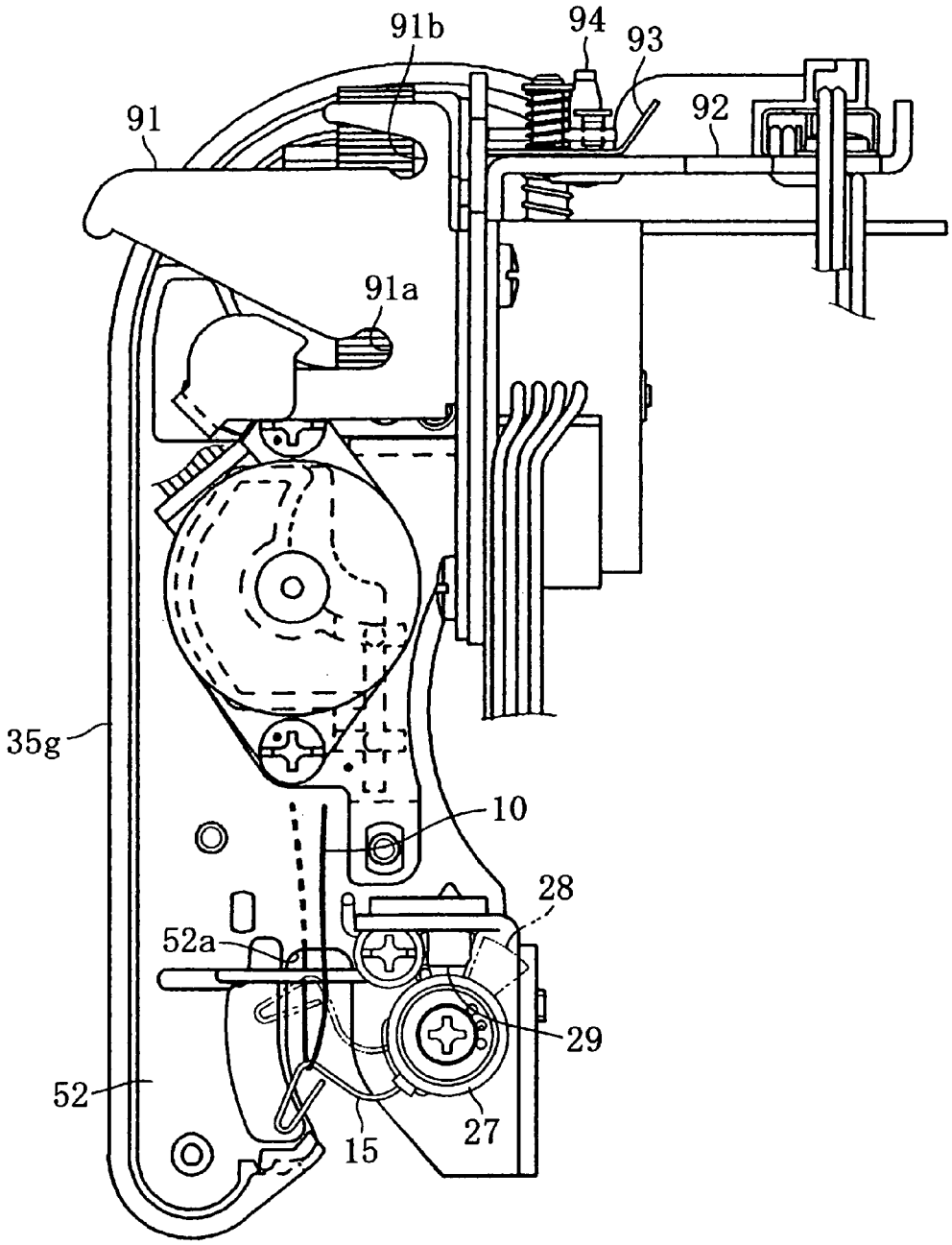
FIG. 10 is a right side view of a first guide frame.

The check spring 15 made of a twisted coil spring is held by a spring holding member 27 mounted on the lower end of the first guide frame 52 which is below the thread tension regulator 14 as shown in FIGS. 10 and 11. It is to be noted that the coiled portion of the check spring 15 is disposed inside the spring holding member 27 and the distal end of the check spring 15 constituting the threading portion threaded by the needle thread 10 is consistently biased counterclockwise when viewed in FIG. 10. Also, a check spring sensor 29 (corresponds to second detection unit) comprising a photosensor is provided in the proximity of the spring holding member 27. A base end of a threading operation piece 28 in a semicircle profile serves as a detection subject portion. The detection subject portion is connected to a base end of the threading portion of the check spring 15. The threading operation piece 28 is supported by the threading portion of the check spring 15. Thus, when the threading portion of the check spring 15 is rotated vertically, the threading operation piece 28 is rotated accordingly.

In case the check spring 15 has no needle thread 10 engaged therewith, the threading operation piece 28 is disposed in a position corresponding to the check spring sensor 29 as shown by solid line in FIG. 10. However, when the needle thread 10 is engaged with the check spring 15, the threading operation piece 28 rotates to the position indicated by a double-dot-chain line shown in FIG. 10, and is moved away from the check spring sensor 29. Then, the check spring sensor 29 outputs a signal indicative of needle thread 10 being engaged with the check spring 15.

Referring to FIGS. 1 to 5, 11, and 12, the sewing machine M includes a first threading route 30 and a first thread guide path 31. A needle thread 10 drawn from the thread spool 9 mounted on the spool pin 8 is set in the first threading route 30. The needle thread 10 is set in the first threading route 30 in standby for the automatic threading of the plurality of threading portions such as the thread tension regulator 14, the check spring 15, the thread take-up 13 carried out by the automatic threading device 16; and also for passing the needle thread 10 through the eye 19*a* of the sewing needle 19 carried out by the automatic needle threading device 17. The first thread guide path 31 is formed in the sewing machine cover 35 so that the needle thread 10 can be introduced to the first threading route 30.

Also, the sewing machine M includes a second threading route 32 and a second thread guide path 33. The plurality of threading portions is threaded by way of the second threading route 32 with the needle thread 10 drawn from the thread spool 9 mounted on the spool pin 8. The second thread guide path 33 formed on the sewing machine cover enables the needle thread 10 to be introduced to the second threading route 32.

Next, the first thread guide path 31 and the second thread guide path 33 will be described in detail hereinafter. Referring to FIGS. 1 to 4, the sewing machine cover 35 comprises a plurality of covers 35*a* to 35*g* which is exposed when the openable cover 6 is opened. More specifically, the plurality of covers comprises an inner arm cover 35*a* extending horizontally so as to cover the substantial right half of the arm 3, a thread introducing front cover 35*b* provided in the left side of the inner arm cover 35*a*, a thread introducing rear cover 35*c* located reward relative to the thread introducing front cover 35*b*, a thread introducing left cover 35*d* located in the left side of the thread introducing front cover 35*b*, a front face cover 35*e* covering the front face of the arm 3, a face plate cover 35*f* covering most of the head 4, and an elongate strip cover 35*g* vertically disposed in the right side of the face plate cover 35*f*.

A slit between the inner arm cover 35*a* and the thread introducing front cover 35*b* defines a guide path 34*a*; a slit between the thread introducing front cover 35*b* and the thread introducing rear cover 35*c* defines a linear thread guide path 34*b*; and a slit between the thread introducing front cover 35*b*, thread introducing left cover 35*d* and the front face cover 35*e* defines a curved guide path 34*c*. A part of the thread guide path 34*c*, as described later, can be switched between the left side route (refer to FIG. 13) and the right side route (refer to FIG. 15).

Furthermore, a slit between the thread introducing left cover 35*d* and the face plate cover 35*f* defines an L-shape guide path 34*d*. A slit between the thread introducing left cover 35*d*, the strip cover 35*g*, and the front face cover 35*e* defines a guide path 34*e*; a slit between the strip cover 35*g* and the face plate cover 35*f* defines a guide path 34*f*; and a slit between the strip cover 35*g* and the thread introducing left cover 35*d* defines a guide path 34*g*.

The guide paths 34*a*, 34*b*, and 34*c* establish a linear connection and the two guide paths 34*d* and 34*f* bifarcate from the lower end of the guide path 34*c*. The four paths 34*a*, 34*b*, 34*c* and 34*d* constitute the first thread guide path 31 and the first thread guide path 31 is used for the first threading route 30 (refer to FIG. 19A) for automatic threading.

Also, the six guide paths 34*a*, 34*b*, 34*c*, 34*d*, 34*f* and 34*g* constitute the second thread guide path 33 and the second thread guide path 33 is used for the second threading route 32 (refer to FIG. 19A) for manual threading. In other words, the guide paths 34*a*, 34*b* and 34*c* are shared between the first and the second thread guide paths 31 and 33. Hence, the first and the second threading routes 30 and 32 share the thread guide paths 34*a*, 34*b*, and 34*c*.

A switch mechanism 100 will be described herein after. The switch mechanism switches the disposition of a movable thread guide path 34C2 constituting a part of the guide path 34*c*. By switching a pair of movable shutter members 102 and 113 in synchronism, the switch mechanism 100 switches the movable thread guide path 34C2 between the left side route situated in the left side of the thread take-up and the right side route situated in the right side of the thread take-up.

Figure 13:
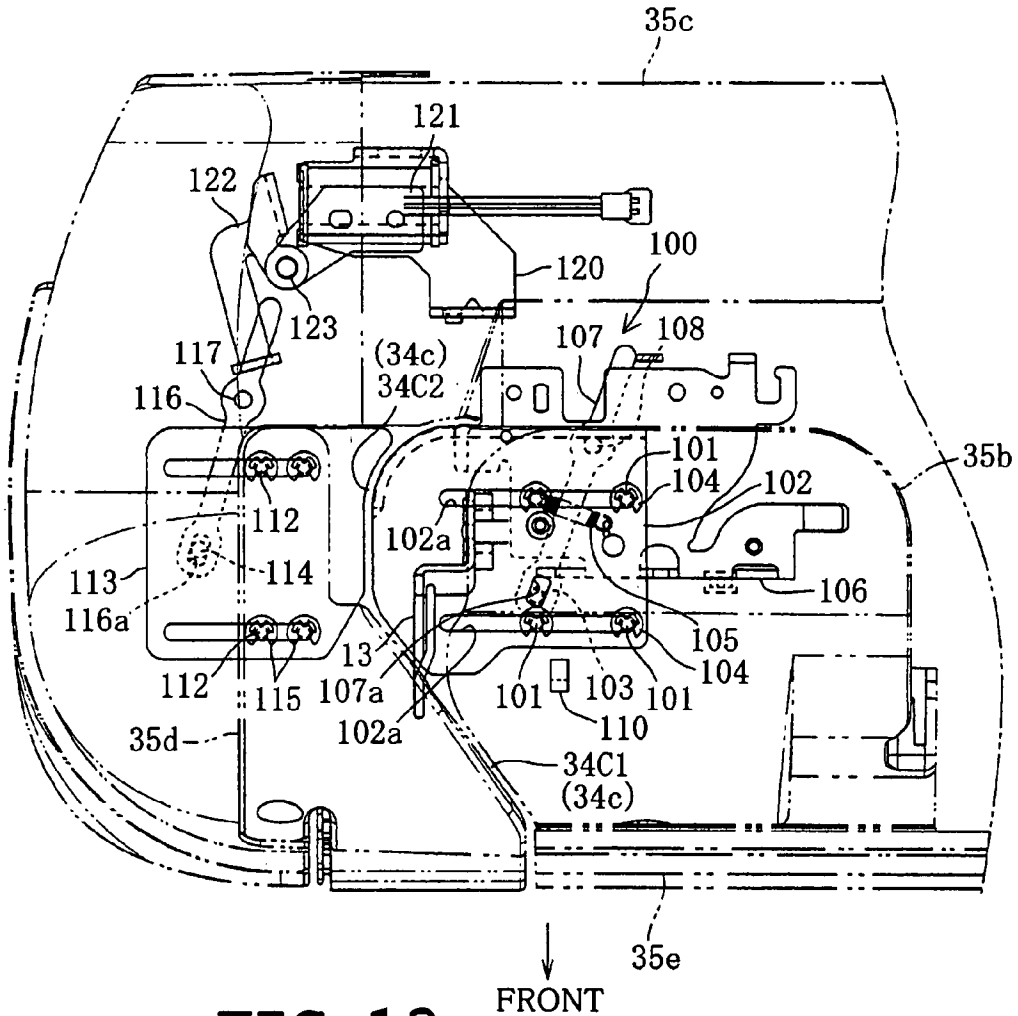
FIG. 13 is a plan view illustrating an inner mechanism of a sewing machine head.
Figure 14:
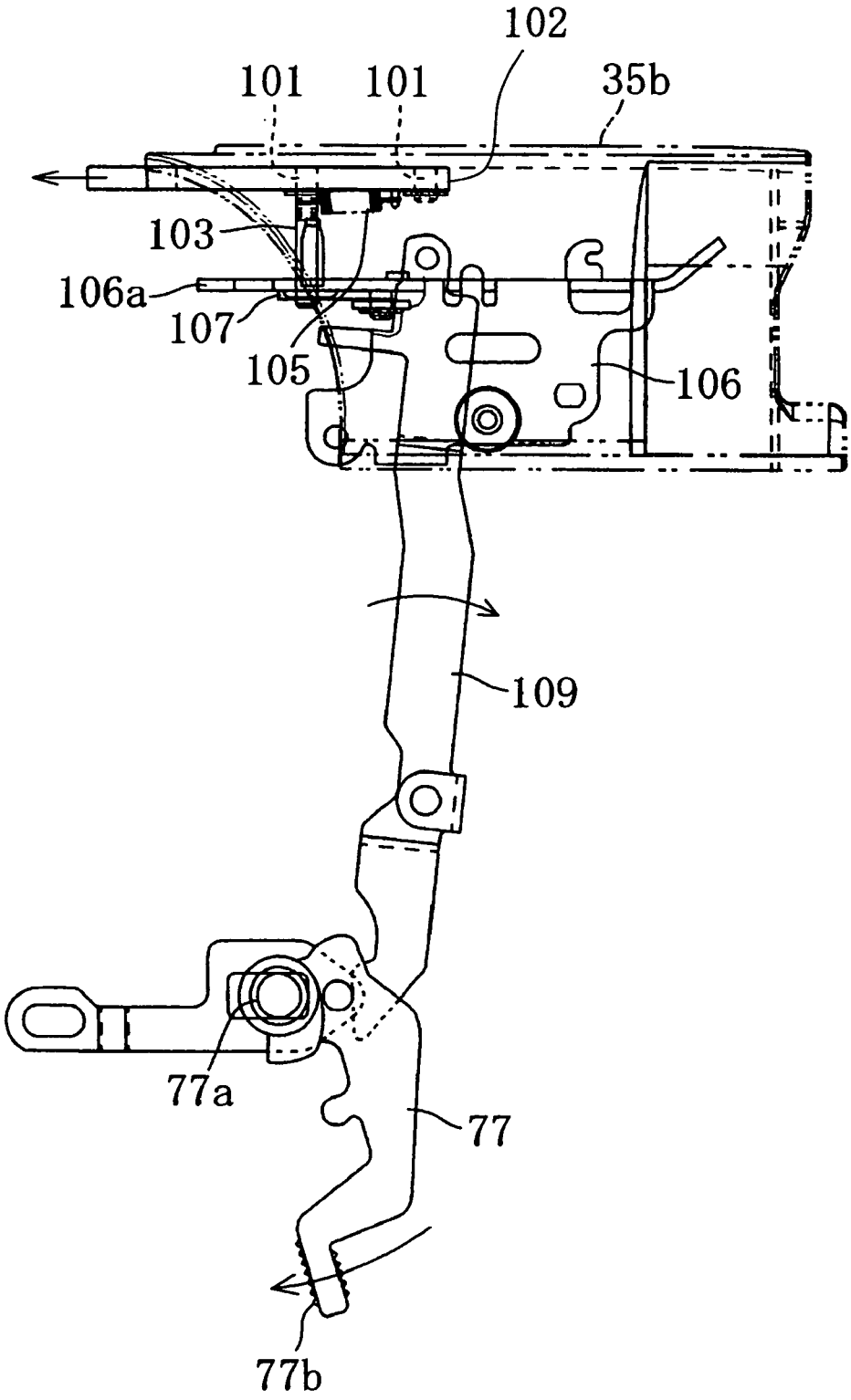
FIG. 14 is a descriptive view of a drive system of a thread introducing front cover and a right shutter member.

Referring to FIGS. 13 and 14, an guide path front portion 34C1 is defined in consistent width in the substantial first half of the thread introducing front cover 35*b* and the thread introducing left cover 35*d*. However, in the second half of the aforementioned covers, the width of the guide path front portion 34C1 is increased in the lateral direction to form a wide slit. Shutter members 102 and 103 are provided under the covers 35*b* and 35*d* respectively in order to define a movable thread guide path 34C2 in the second half of the covers that has a similar profile as the guide path front portion 34C1. The shutter members 102 and 103 are provided also for the purpose of switching the movable thread guide path 34C2 between the right side route and the left side route.

The right shutter member 102 (corresponding to first movable member) provided in the underside of the thread introducing front cover 35*b* will be described hereinafter. As shown in FIGS. 13 and 14, four downwardly extending support pins 101 are integrally formed in the underside of the second half of the thread introducing front cover 35*b* respectively. The support pins 101 are disposed in separate rows: two in the front row and two in the back row.

The right shutter member 102 in a plate-profile is disposed immediately under the thread introducing front cover 35*b*. A couple of parallel slits 102*a* having a predetermined lateral length is aligned in one in front of the other in the right shutter member 102. A downwardly oriented engagement pin 103 is integrally formed in the proximity of the support pin 101 so as to correspond to the support pins 101 in the front row.

The right shutter member 102 is supported as follows. The support pins 101 associated with each slit 102*a* of the right shutter member 102 respectively penetrate the associated slits 102*a*. Then, an E-ring (stopper member) is fitted on the lower end of each support pin 101. Due to such construction, in the portion immediately below the thread introducing front cover 35*b*, the right shutter member 102 in the horizontal disposition is arranged slidably so as to switch the movable thread guide path 34C2 between the left side position and the right side position via the engagement of the support pins 101 and the slits 102*a*. When the right shutter member 102 is moved to the left side position (corresponding to a first position corresponding position), the left end of the right shutter member 102 is placed in the left side of the thread take-up 13 so as to place the movable thread guide path 34C2 in the left side of the thread take-up 13 (refer to FIG. 13). When the right shutter member 102 is moved to the right side position (corresponding to a second-position corresponding position), the left end of the right shutter member 102 is placed in the right side of the thread take-up 13 so as to place the movable thread guide path 34C2 in the right side of the thread take-up 13 (refer to FIG. 15).

However, since the support pin 101 and the right shutter member 102 are connected by a helical extension spring 105, the right shutter member 102 is consistently biased toward the left side position. A substantial rear end of a longitudinally disposed right shutter operating lever 107 is pivoted by a pin 108 to a horizontal wall 106*a* of a support plate 106 affixed to the sewing machine frame corresponding to the position below the right shutter member 102.

The lower end of the engagement pin 103 of the right shutter member 102 is engaged with the engagement hole 107*a* defined in the front end of the right shutter operating lever 107. The rear end of the right shutter operating lever 107 abuts the upper end of a presser-foot-lifting interlock lever 109 from the left. The presser-foot-lifting interlock lever 109 is interlocked with the later described presser bar lifting mechanism 70. Thus, when the upper half of the presser-foot-lifting interlock lever 109 is rotated to the right (refer to FIG. 14), the right shutter member 102 slides to the left side position (refer to FIG. 13) via the right shutter operating lever 107. When the upper half of the presser-foot-lifting interlock lever 109 is moved to the left (refer to FIG. 16), the right shutter member 102 slides to the right side position (refer to FIG. 15) via the right shutter operating lever 107.

A slide detection sensor 110 (corresponding to first detection unit) comprising a photosensor is provided on the support plate 106 corresponding to the front end proximity of the right shutter member 102 in order to detect the sliding of the right shutter member 102 to the right side position.

Figure 15:
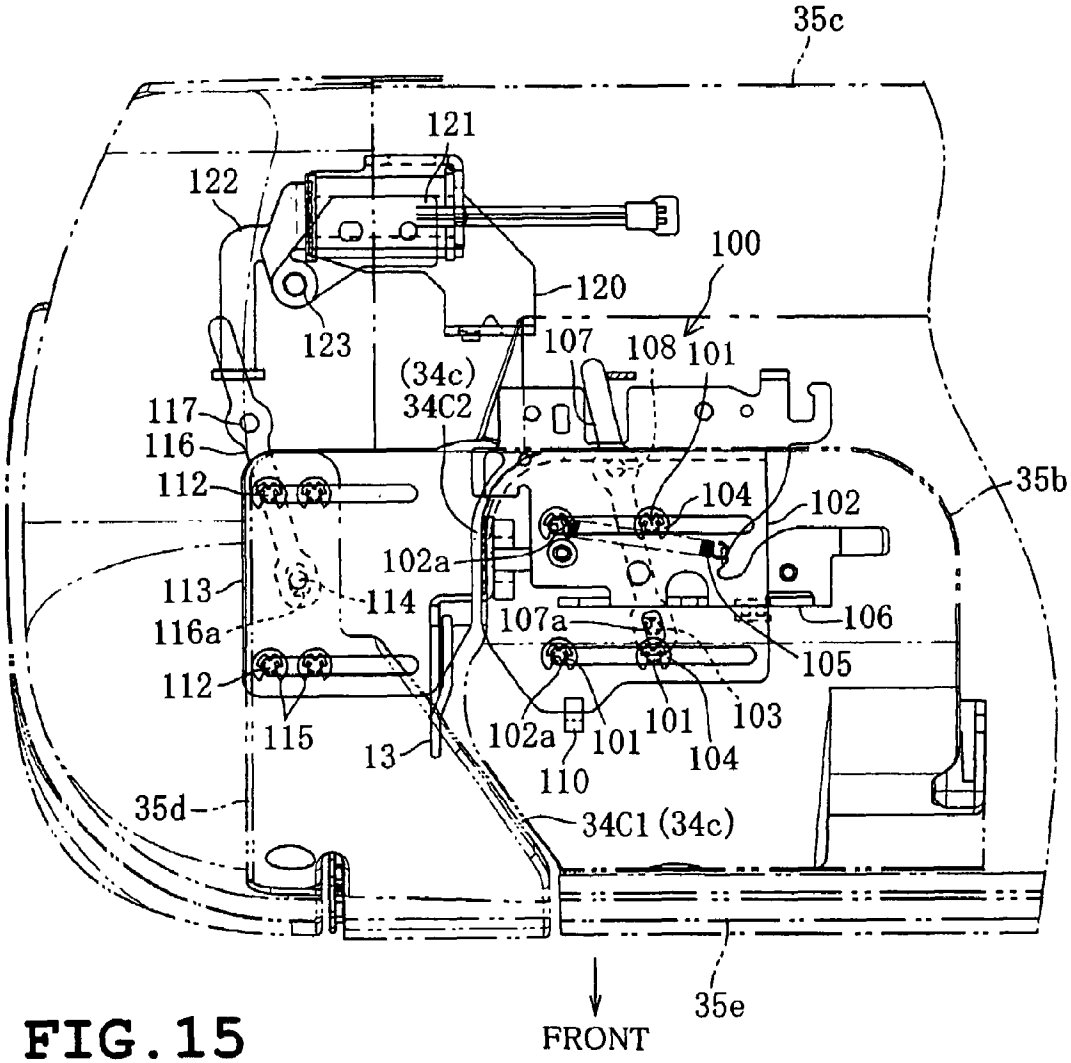
FIG. 15 is a plan view illustrating the inner mechanism of a sewing machine head.

Next, a description will be given on the left shutter member 113 (corresponds to second movable member) provided in the underside of the thread introducing left cover 35*d*. Referring to FIGS. 13 and 15, four downwardly extending support pins 112 are integrally formed in the underside of the second half portion of the thread introducing left cover 35*d* respectively. The support pins 112 are disposed in separate rows: two in the front row and two in the back row. The left shutter member 113 in a plate-profile is disposed immediately under the thread introducing left cover 35*d*. A couple of parallel slits 113*a* having a predetermined length in the lateral direction is aligned one in front of the other in the left-shutter member 113. Also, a downwardly extending engagement pin 114 is integrally formed in the left shutter member 113.

The left shutter member 113 is supported as follows. The support pins 112 associated with each slit 113*a* of the left shutter member 113 respectively penetrate the associated slits 113*a*. Then, an E-ring 115 (stopper member) is fitted to the lower end of each support pin 112. Due to such construction, in the portion immediately under the thread introducing left cover 35*d*, the left shutter member 113 in the horizontal disposition is arranged to be slidable. The left shutter member 113, when moved to the left, is disposed in the left side position (corresponds to first position corresponding position) in which the right side thereof is located to the left side of the thread take-up 13 so as to dispose the thread guide path 34*c* to the left side (refer to FIG. 13) of the thread take-up 13. When the left shutter member 113 is moved to the right side position (corresponding to second-position corresponding position), the right end of the left shutter member 113 is placed in the right side of the thread take-up 13 so as to place the thread guide path 34*c* in the right side of the thread take-up 13 (refer to FIG. 15)

A substantial rear end of a longitudinally disposed left shutter operating lever 116 is pivoted by a pin 117 to the underside of a thread introducing left cover 35*d* immediately rearward relative to the left shutter member 113. The lower end of the engagement pin 114 of the left shutter member 113 is engaged with the engagement hole 116*a* defined on the front end of the left shutter operating lever 116.

Furthermore, a support plate 120 (corresponds to second drive unit) having a magnet 121 affixed thereto is coupled to the sewing machine frame located reward relative to the left shutter member 113. Further, a rotating lever 122 in a substantially L-shape in plan view is rotatably pivoted to the support plate 120 by a pivot pin 123. An adsorbing portion of the rotating lever 122 is adsorbable to the magnet 121, and the front end of an operating link of the rotating lever 122 is linked to the rear end of the left shutter operating lever 116.

In case the magnet 121 is demagnetized, the rotating lever 122 is consistently rotationally biased in the unadsorbing position shown in FIG. 13 by the helical extension spring not shown. Hence, the left shutter member 113 is consistently positioned in the left side position via a clockwise rotation of the left shutter operating lever 116. However, when the magnet 121 is magnetized, the rotating lever 122 is rotated to the adsorbing position as shown in FIG. 15. Accordingly, the left shutter member 113 slides to the right side position via the counterclockwise rotation of the left shutter operating lever 116.

The second threading route 32 includes the movable thread guide path 34C2 of the first threading route 30. That is, the guide path defined by the left and right shutter members 102 and 113 constitute the movable thread guide path 34C2. When the right and left shutter members 102 and 113 are simultaneously slid to the left side position (refer to FIG. 13), the movable thread guide path 34C2 is switched to the left side route (corresponds to first position) whereas when the right and left shutter members 102 and 113 are slid to the right side position (refer to FIG. 15), the movable thread guide path 34C2 is switched to the right side route (corresponds to second position).

As shown in FIG. 5, the sewing machine M is arranged to be capable of automatically threading the first threading route 30 and manually threading the second threading route 32 with the needle thread 10 respectively, with the thread take-up 13 disposed substantially in the uppermost position which is the most suitable position for threading the thread take-up 13 with the needle thread 10. Under such construction, by operating the thread standby switch, the thread take-up 13 is automatically moved to the most suitable position for threading the thread take-up 13 and stopped at such position so that both manual and automatic threading can be carried out.

Under such construction, there is no possibility of the needle thread 10 being engaged with the threading portion 41 of the thread take-up 13 when the movable thread guide path 34C2 of the second threading route 32 is switched to the right side route positioned in the right side of the thread take-up 13 and the needle thread 10 drawn from the thread spool 9 is manually threaded downward through the guide path 34*c*.

On the other hand, the thread take-up 13 can be engaged with the needle thread 10 when the movable thread guide path 34C2 of the second threading route 32 is switched to the left side route positioned in the left side of the thread take-up 13 and the needle thread 10 drawn from the thread spool 9 manually threaded downward via the guide path 34*c*.

Figure 17:
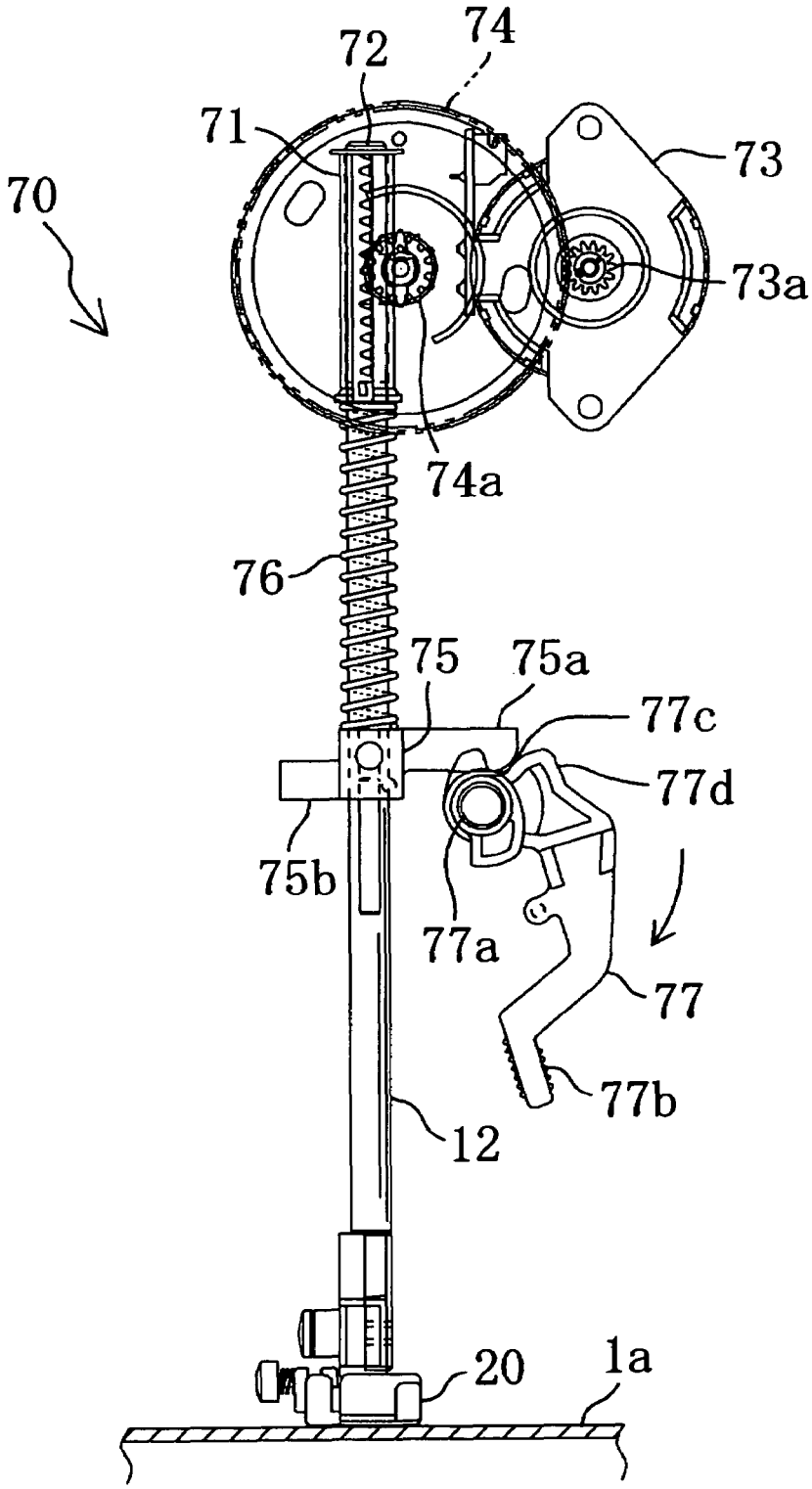
FIG. 17 is schematic front view of a presser bar lifting mechanism in a cloth pressing state.

Next, the presser bar 12 will be explained based on FIGS. 17 and 18. The presser bar 12 can be vertically moved by operating the presser foot lifting lever 77 as well as being driven electrically in the vertical direction by a presser bar lifting mechanism 70.

The presser bar lifting mechanism 70 is disposed behind the needle bar 11. The presser bar lifting mechanism 70 includes the presser bar 12 having a presser foot 20 attached to the lower end thereof and is supported vertically movably to the sewing machine frame, a rack forming member 71 fitted vertically movably on the upper end portion of the presser bar 12, a presser foot lifting pulse motor 73 that vertically moves the presser bar 12, and a presser foot lifting lever 77 capable of vertically moving the presser bar 12 independent of the vertical movement of the presser bar 12 by the presser foot lifting pulse motor 73.

The rack forming member 71 is fitted on the upper end of the presser bar 12 in a vertical movable manner. A stopper ring 72 is affixed on the upper end of the presser bar 12. The presser foot lifting pulse motor 73 is affixed to the sewing machine frame in the immediate right side of the rack forming member 71. A drive gear 73*a* is linked to an output shaft of the presser foot lifting pulse motor 73. An intermediate gear 74 in mesh engagement with the drive gear 73*a* and a pinion 74*a* in mesh engagement with the rack forming member 71 are formed integrally.

Furthermore, a presser bar clamp 75 is affixed to the vertical mid-portion of the presser bar 12 and a presser spring 76 is disposed about the portion of the presser bar 12 located between the rack forming member 71 and the presser clamp 75. It is to be noted that a coil spring not shown which is biased in the clockwise direction is provided on the presser foot lever 77.

One end of the presser foot lifting lever 77 is rotatably supported by a pivot pin 77*a* affixed to the sewing machine frame. By manually operating an operation portion 77*b* provided on the other end of the presser foot lifting lever 77, the presser foot lifting lever 77 can be rotated between the lowered position shown in FIG. 17, and the lifted position shown in FIG. 18. The presser bar 12 and the presser foot 20 attached thereto are vertically moved by the rotation of the presser foot lifting lever 77.

The presser foot lifting lever 77 includes a cam surface 77*d* contacting a cam follower 75*a* provided integrally with the presser bar clamp 75. When the presser foot lifting lever 77 is switched to the lowered position shown in FIG. 17, a small space is occurs between a boss surface 77*c* of the presser foot lifting lever 77 and the cam follower 75*a* and the presser bar 12 is switched to the pressure position in which the presser foot 20 contacts the needle plate 1*a*.

Figure 18:
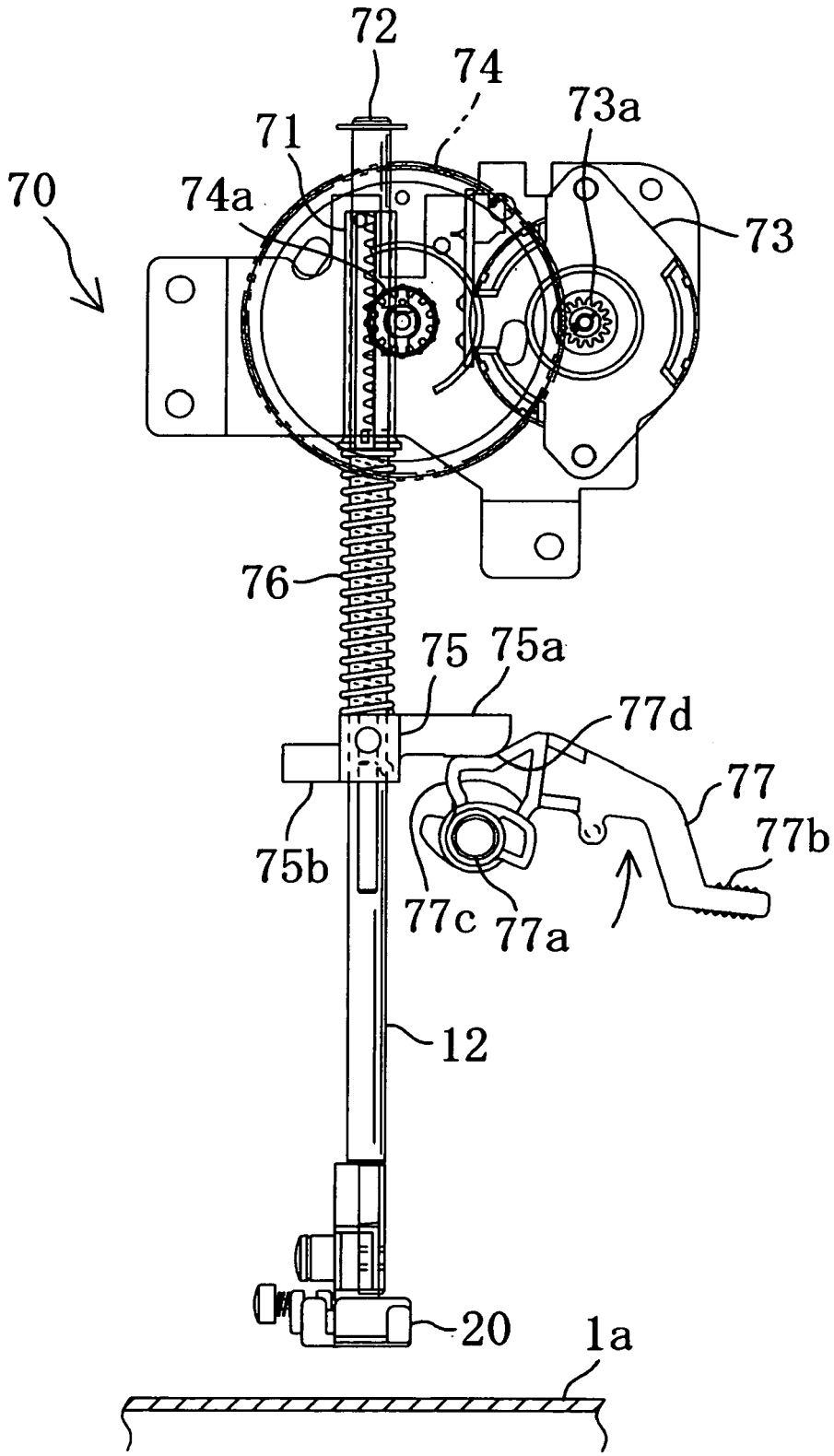
FIG. 18 corresponds to FIG. 17 in a non-cloth pressing state.

When the presser foot lifting lever 77 is switched to the lifted position shown in FIG. 18, the cam surface 77*d* and the cam follower 75*a* are placed in abutment and the presser bar 12 is switched to a retracted position in which the presser bar 12 is raised. At this time, since the presser foot lifting pulse motor 73 is energized in a non-rotating state, the vertical position of the rack forming member 71 remains unchanged.

As a result, the presser spring 76 is compressed and the cam follower 75*a* is pressed in abutment with the cam surface 77*d* by the elasticity of the presser spring 76. The pressure exerted in the abutment urges the presser foot lifting lever 77 in the counterclockwise direction. Hence, the presser foot lifting lever 77 is locked in the lifted position.

When the presser foot lifting pulse motor 73 is driven, the drive force is conveyed to the intermediate gear 74 and the pinion 74*a* and thereby vertically moves the rack forming member 71. As shown in FIG. 17, when the rack forming member 71 is raised, the upper end surface thereof raises the stopper ring 72 affixed to the upper end of the presser bar 12, consequently raising the presser foot 20.

FIG. 18 illustrates the presser foot 20 raised by manual operation of the presser foot lifting lever 77 being driven to the lowermost position by the presser foot lifting pulse motor 73. More specifically, the presser foot lifting lever 77 is rotated to the lowered position shown in FIG. 17 by disengaging the presser foot lifting lever 77 and the cam follower 75*a* by the drive of the presser foot lifting pulse motor 73, consequently lowering the presser foot 20 as well. The details of the above operation will be described hereinafter.

From the state illustrated in FIG. 18, the rack forming member 71 is raised to the uppermost position by driving the presser foot lifting pulse motor 73. Since the upper end surface of the rack forming member 71 raises the stop ring 72 affixed to the upper end of the presser bar 12, the presser bar clamp 75 is raised along with the presser bar 12. As a result, the abutment between the cam follower 75*a* and the cam surface 77*d* of the presser foot lifting lever 77 is released and the presser foot lifting lever 77 is rotated clockwise to the lowered position by the clockwise bias of the coil spring provided on the presser foot lifting lever 77.

Thereafter, the rack forming member 71 is lowered by driving the presser foot lifting pulse motor 73, whereby the presser bar 12 is lowered as well. The presser foot lifting lever 77, the presser-foot-lifting interlock lever 109, the right shutter activating member 107, but not limited to the foregoing, constitute the first drive unit.

Next, a description will be given on the automatic threading device 16. As shown in FIGS. 11, 12, 19A to 19F, 20A to 20F, and 21A to 21F, the automatic threading device 16 includes a first thread carrier mechanism 50 having a first thread carrier member 51 that threads a plurality of threading portions (thread tension regulator 14, check spring 15, thread take-up 13, or the like) inclusive of the thread take-up 13 by carrying the needle thread 10 set to the first threading route 30. The automatic threading device further includes a first pulse motor 54 that drives the first thread carrier mechanism 50; the second thread carrier mechanism 60 having a second thread carrier member 61 that carries the needle thread 10 disposed in a lower stream of the thread take-up 13; and a second pulse motor 69 that drives the second thread carrier mechanism 60.

The first thread carrier member 51 of the first thread carrier mechanism 50 catches and carries the needle thread 10 disposed in the upper stream relative to the thread guide portion 43 of the thread take-up 13 toward the check spring 15. On the way to the check spring 15, the first thread carrier member 51 threads the thread tension mechanism 14 and thereafter the check spring 15 with the needle thread 10. The first and the second thread carrier members 51 and 61 of the first and the second thread carrier mechanisms 50 and 60 thread the threading portion 41 of the thread take-up 13 with the needle thread 10 in the process of carrying the needle thread 10.

Figure 19A:
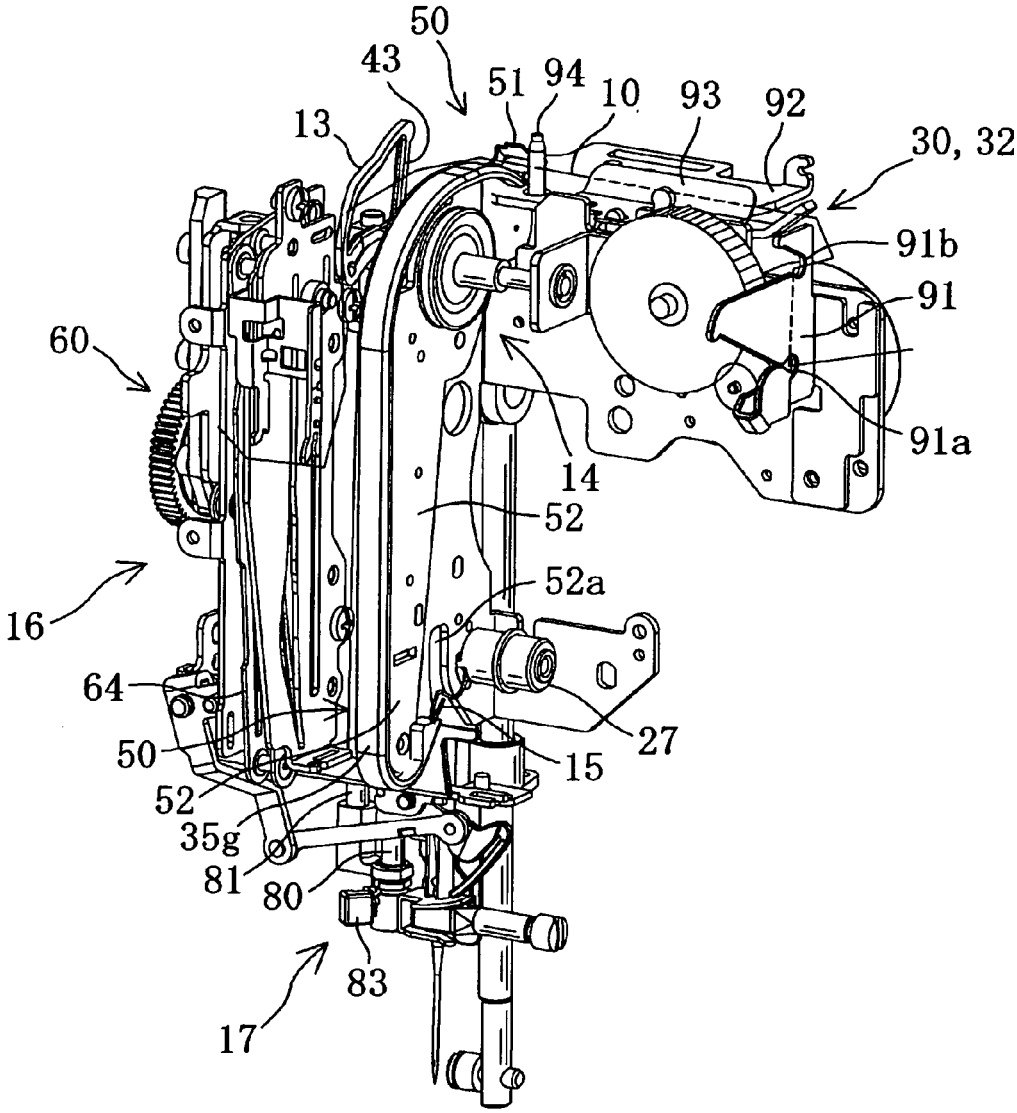
FIG. 19A is a perspective view of the automatic threading device and the automatic needle threading device (in standby state)
Figure 19B:
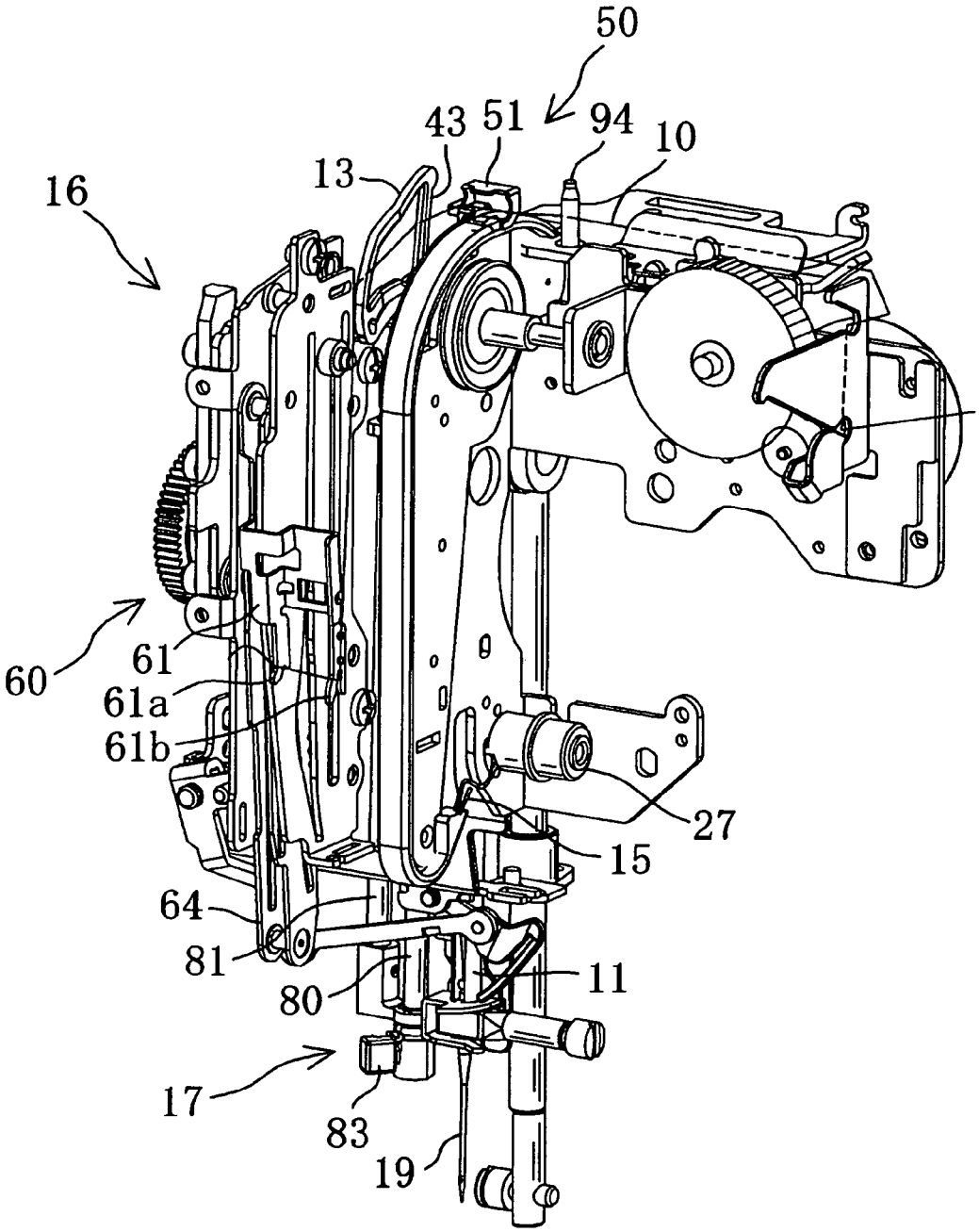
FIG. 19B is a perspective view of the automatic threading device and the automatic needle threading device (in threading state)
Figure 19C:
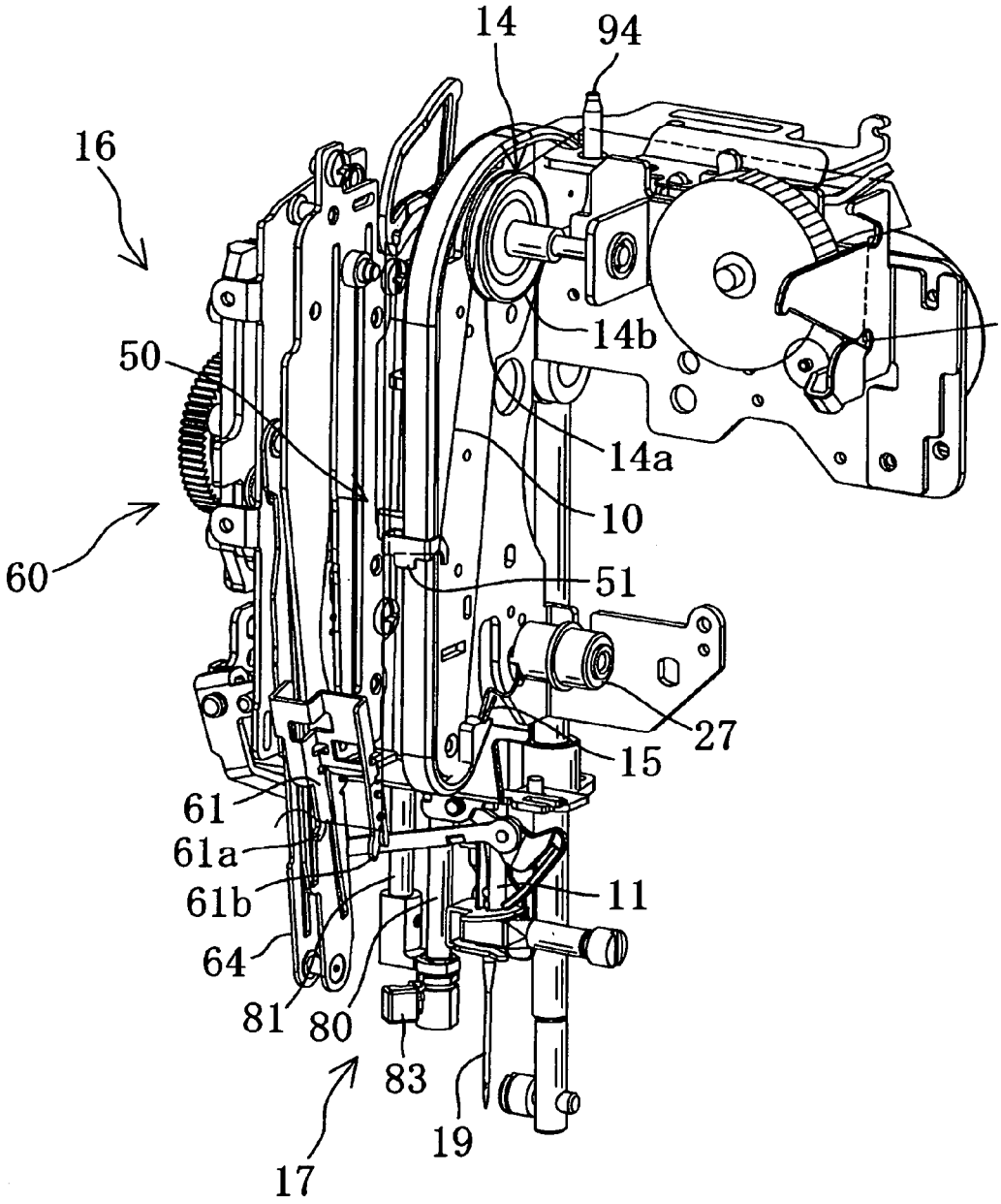
FIG. 19C is a perspective view of the automatic threading device and the automatic needle threading device (in thread take-up threading state)
Figure 19D:
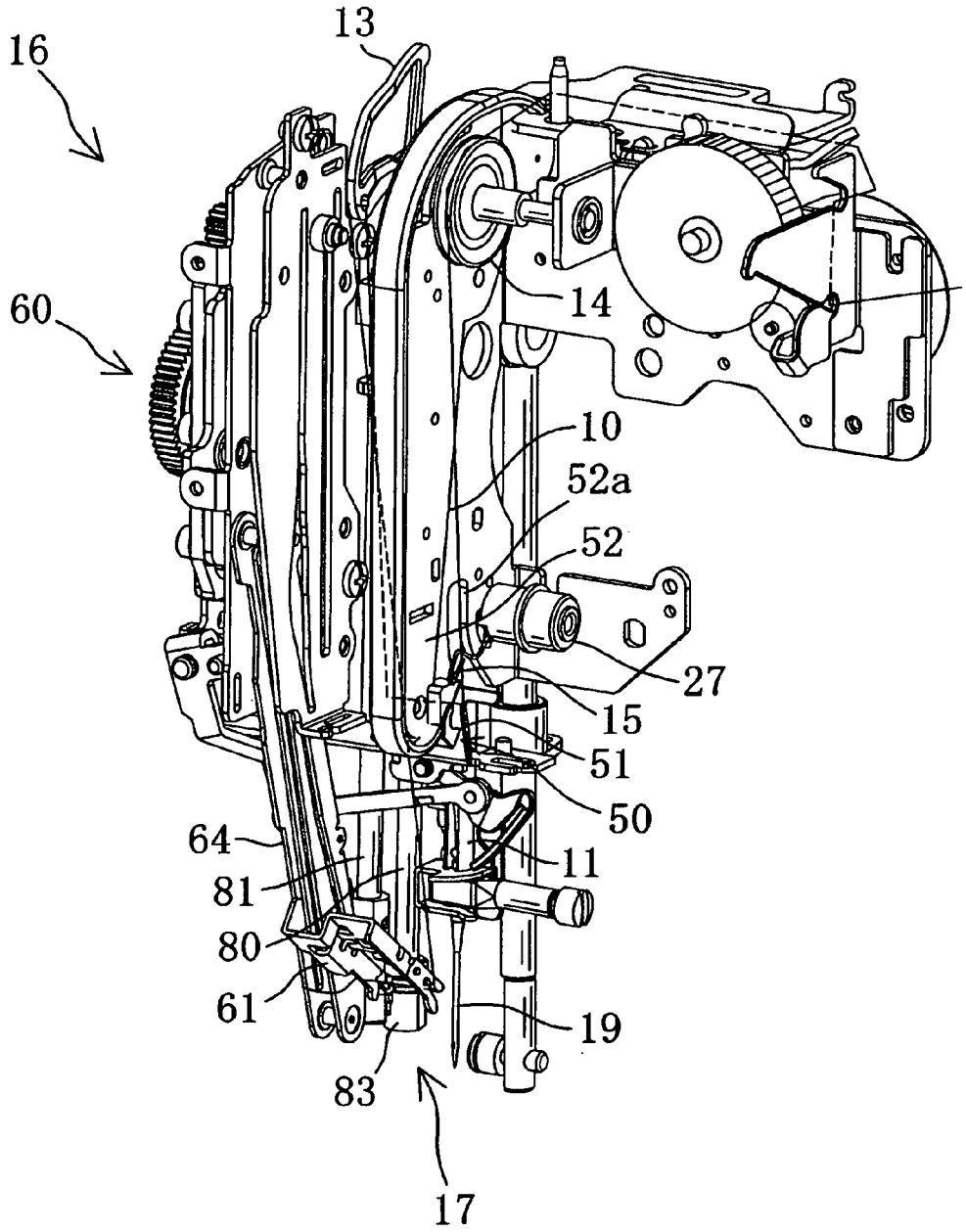
FIG. 19D is a perspective view of the automatic threading device and the automatic needle threading device (in check spring threading state)
Figure 20A:
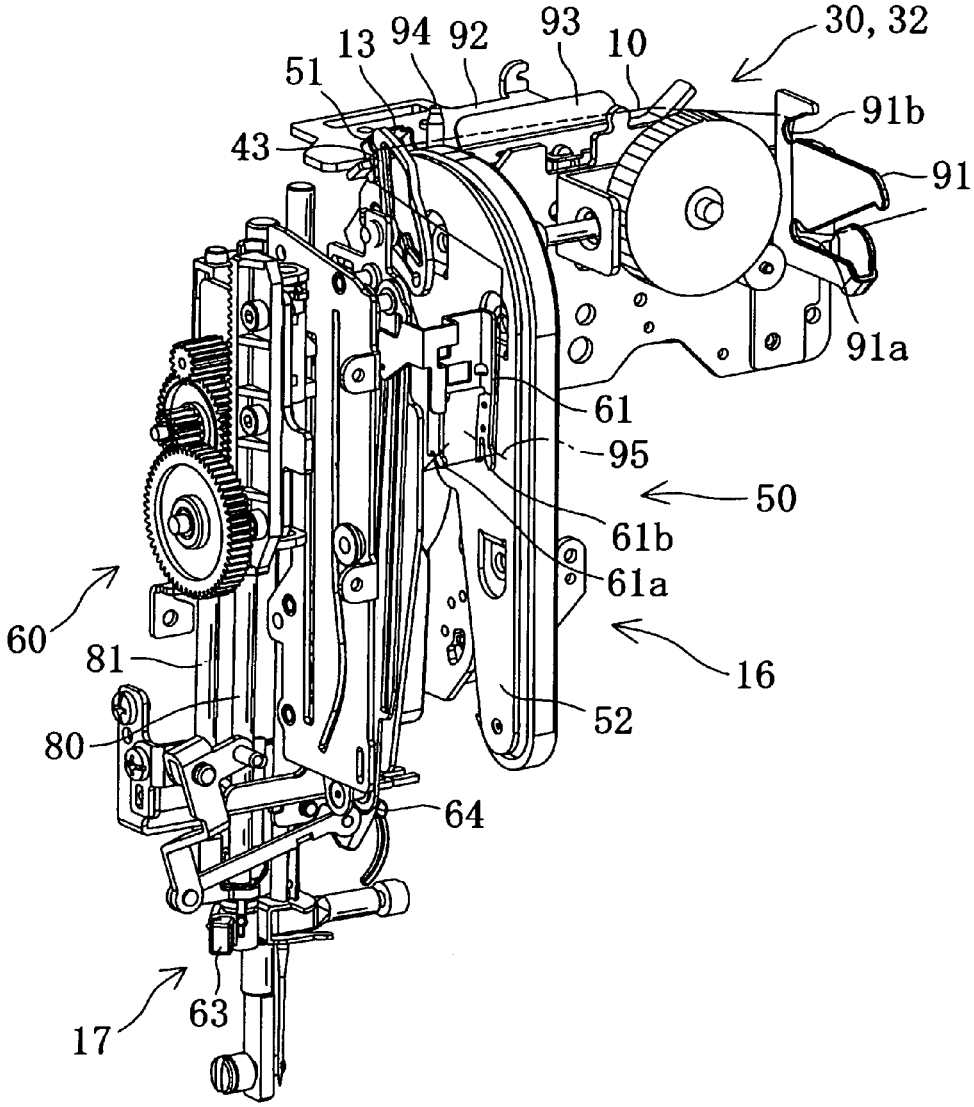
FIG. 20A is a perspective view of the automatic threading device and the automatic needle threading device (in standby state)
Figure 20B:
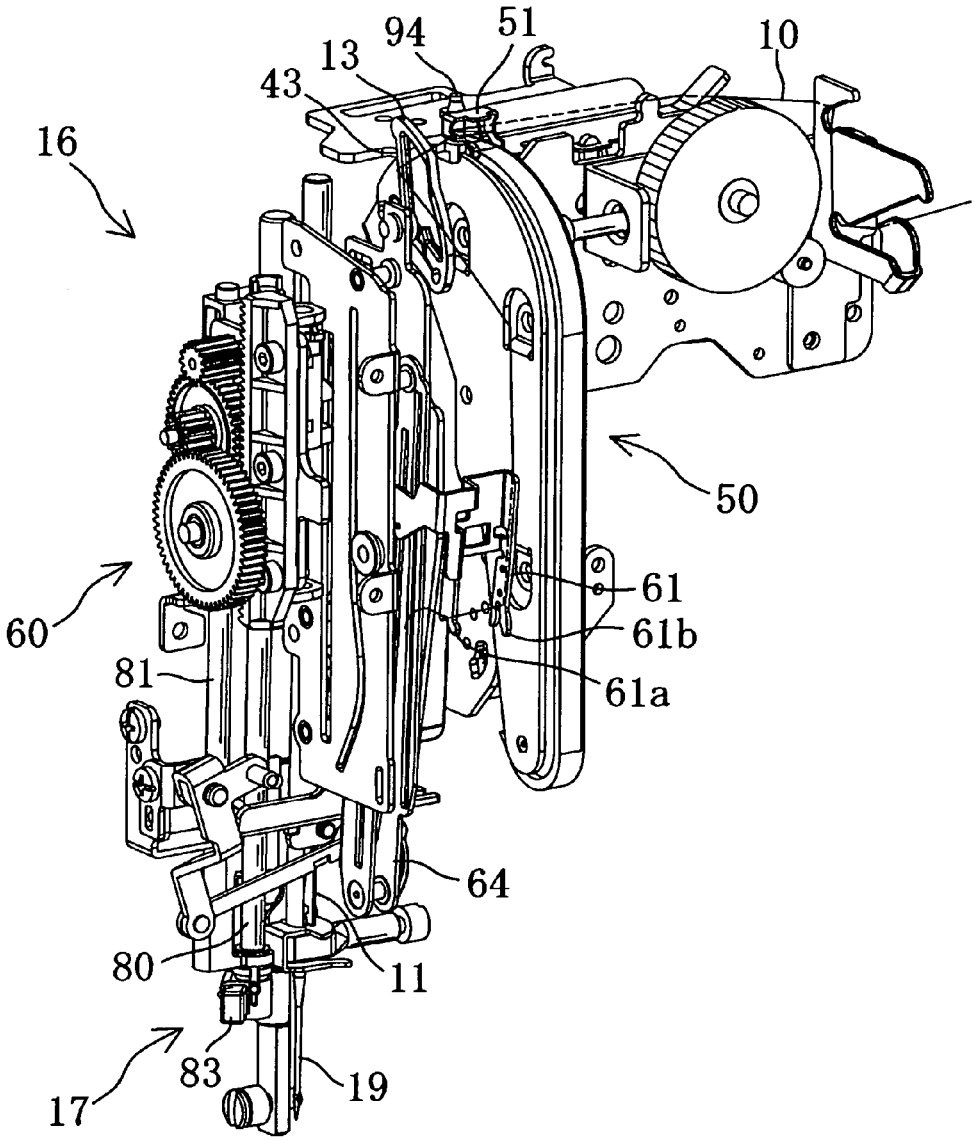
FIG. 20B is a perspective view of the automatic threading device and the automatic needle threading device (in needle threading state)
Figure 20C:
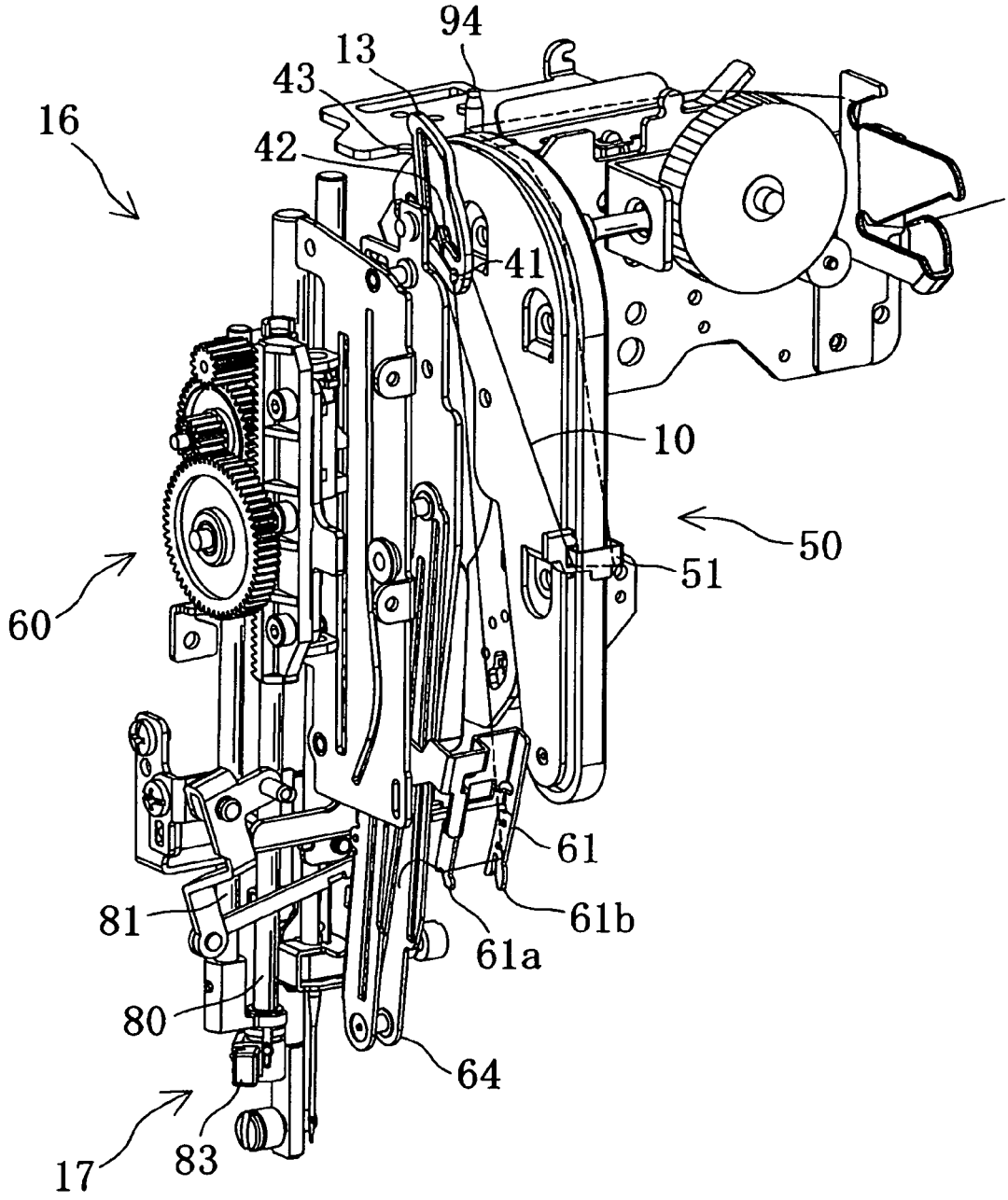
FIG. 20C is a perspective view of the automatic threading device and the automatic needle threading device (in thread take-up threading state)
Figure 20D:
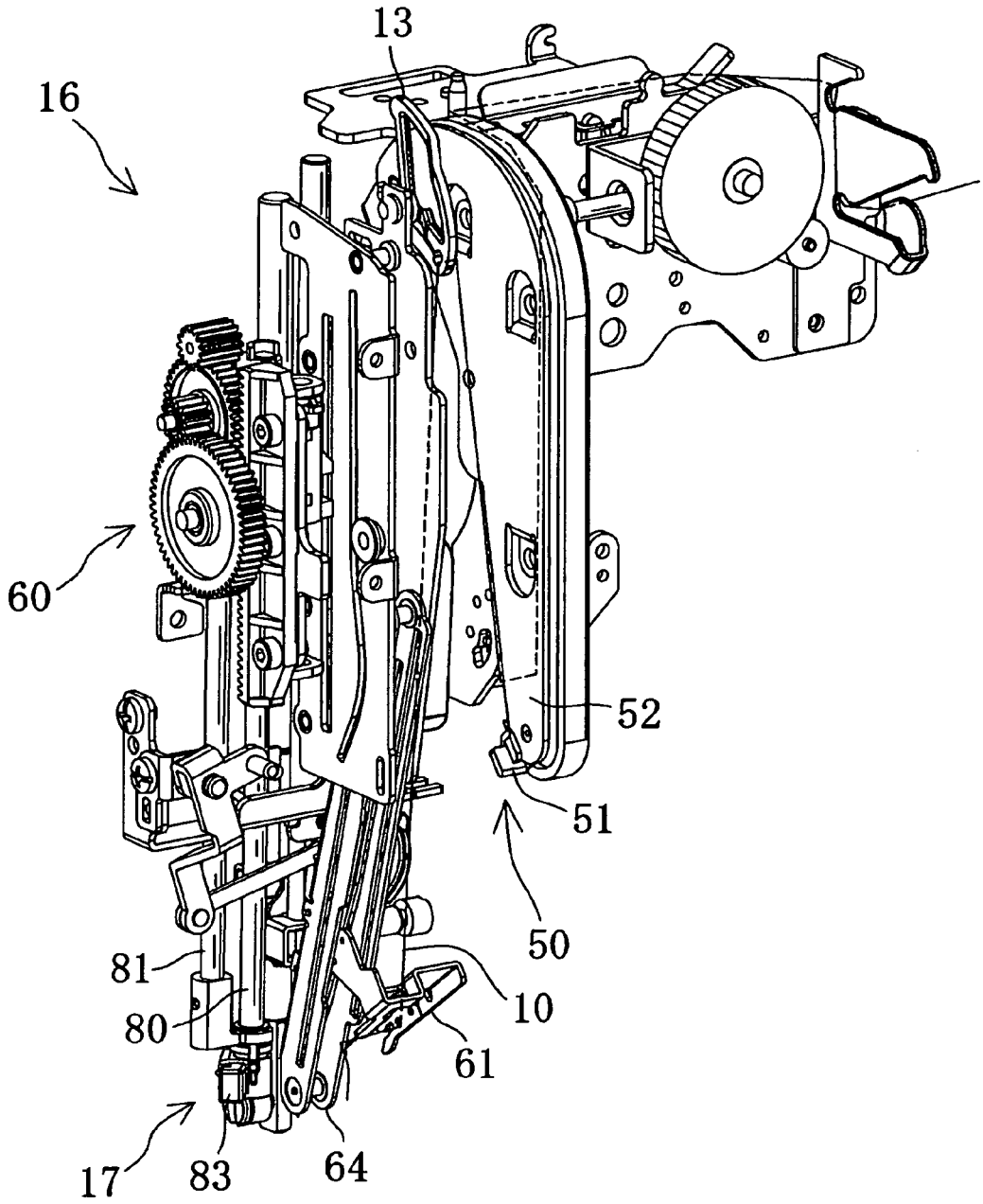
FIG. 20D is a perspective view of the automatic threading device and the automatic needle threading device (in check spring threading state)
Figure 21A:
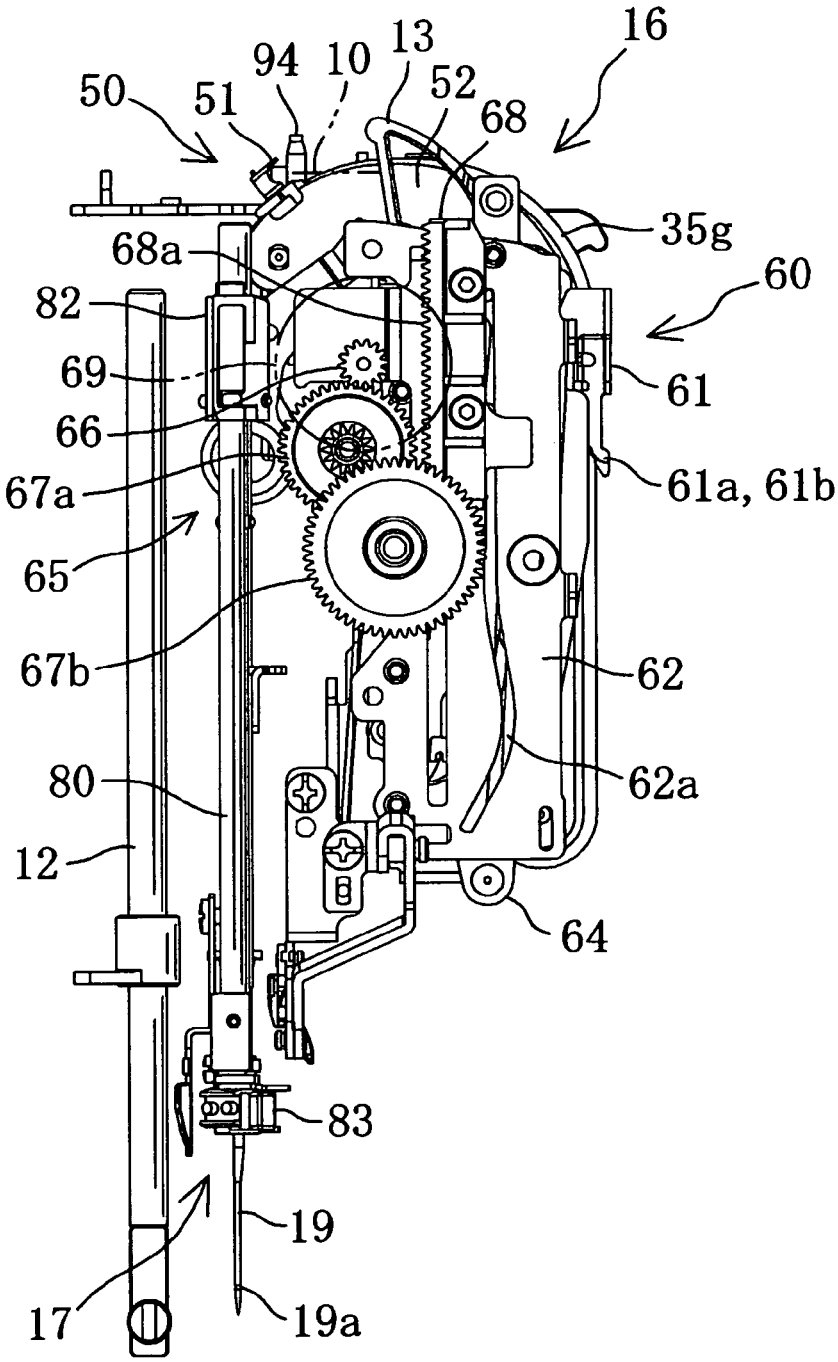
FIG. 21A is a perspective view of the automatic threading device and the automatic needle threading device (in standby state)

The first thread carrier mechanism 50 includes a first guide frame 52 affixed to the sewing machine frame; a first thread carrier member 51 movable between a standby position shown in FIGS. 19A, 20A, and 21A and the thread transfer position shown in FIGS. 19D and 20D with guidance and support of the first guide frame 52; and a first drive mechanism (not shown) that drives the first thread carrier member 51. The first guide frame 52 is disposed to the right side of the needle bar 11 and the thread take-up 13, and takes on a vertically elongated frame-form having laterally oriented surfaces. The first guide frame 52 is outlined by the upper end edge portion taking on a large-diameter circumference; the front end edge portion in a vertically elongated linear profile; and the lower end edge portion taking on a small-diameter circumference. A strip cover 35*g* is affixed along the upper end edge, the front edge, and the lower end edge portion.

The thread tension regulator 14 and the check spring 15 are disposed in the right side of the first guide frame 52. More specifically, the thread tension discs 14*a* and 14*b* of the thread tension regulator 14 are mounted to the upper end of the first guide frame 52 via the thread tension shaft 14*c* and the check spring 15 is mounted on the lower end of the first guide frame 52. An upwardly extending notch 52*a* is defined in the lower end of the first guide frame 52 and the check spring projects toward the throat of the notch 52*a*. The notch 52*a* ensures the functioning of the check spring 15.

Figure 21B:
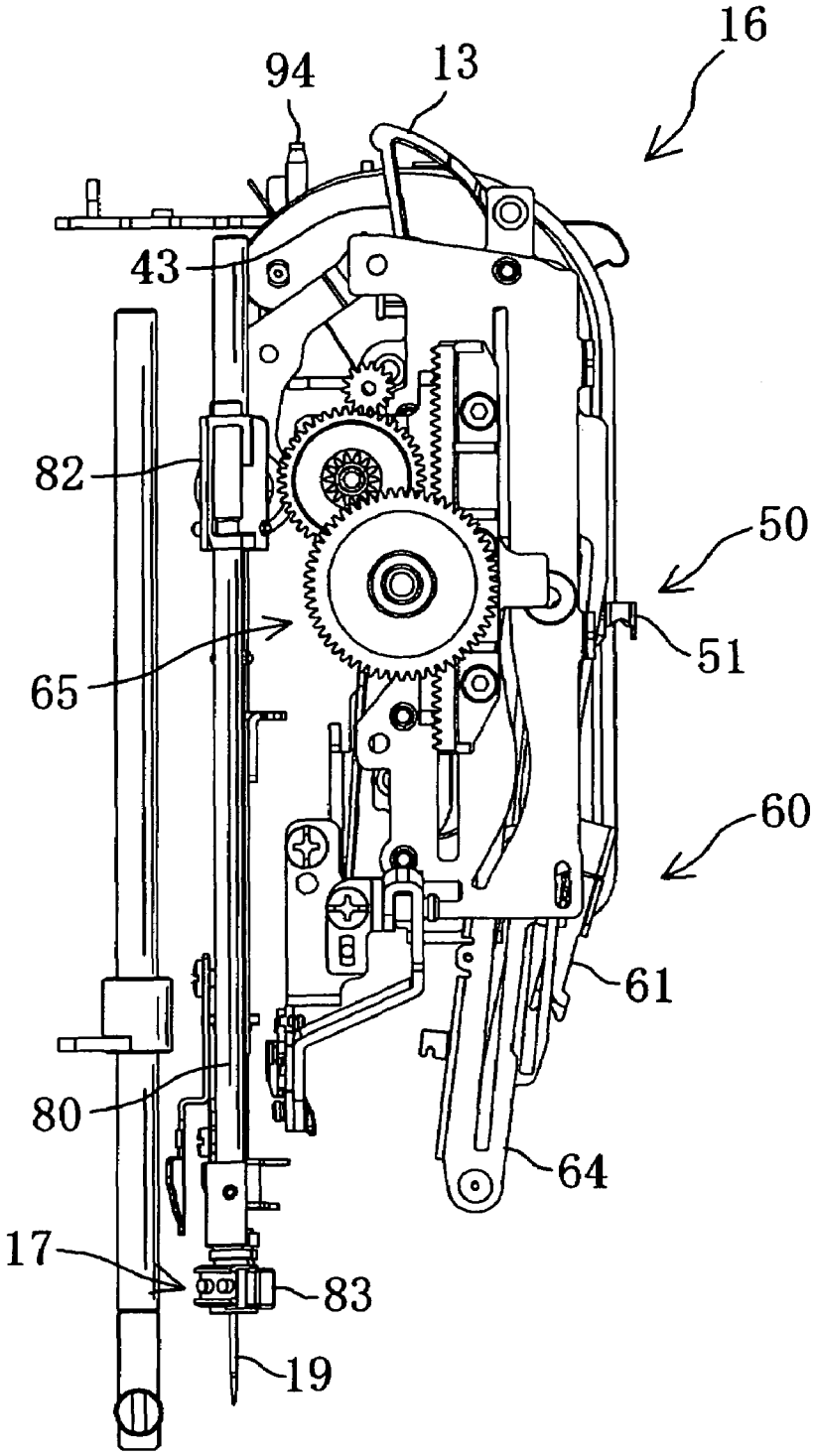
FIG. 21B is a perspective view of the automatic threading device and the automatic needle threading device (in needle threading state)
Figure 21C:
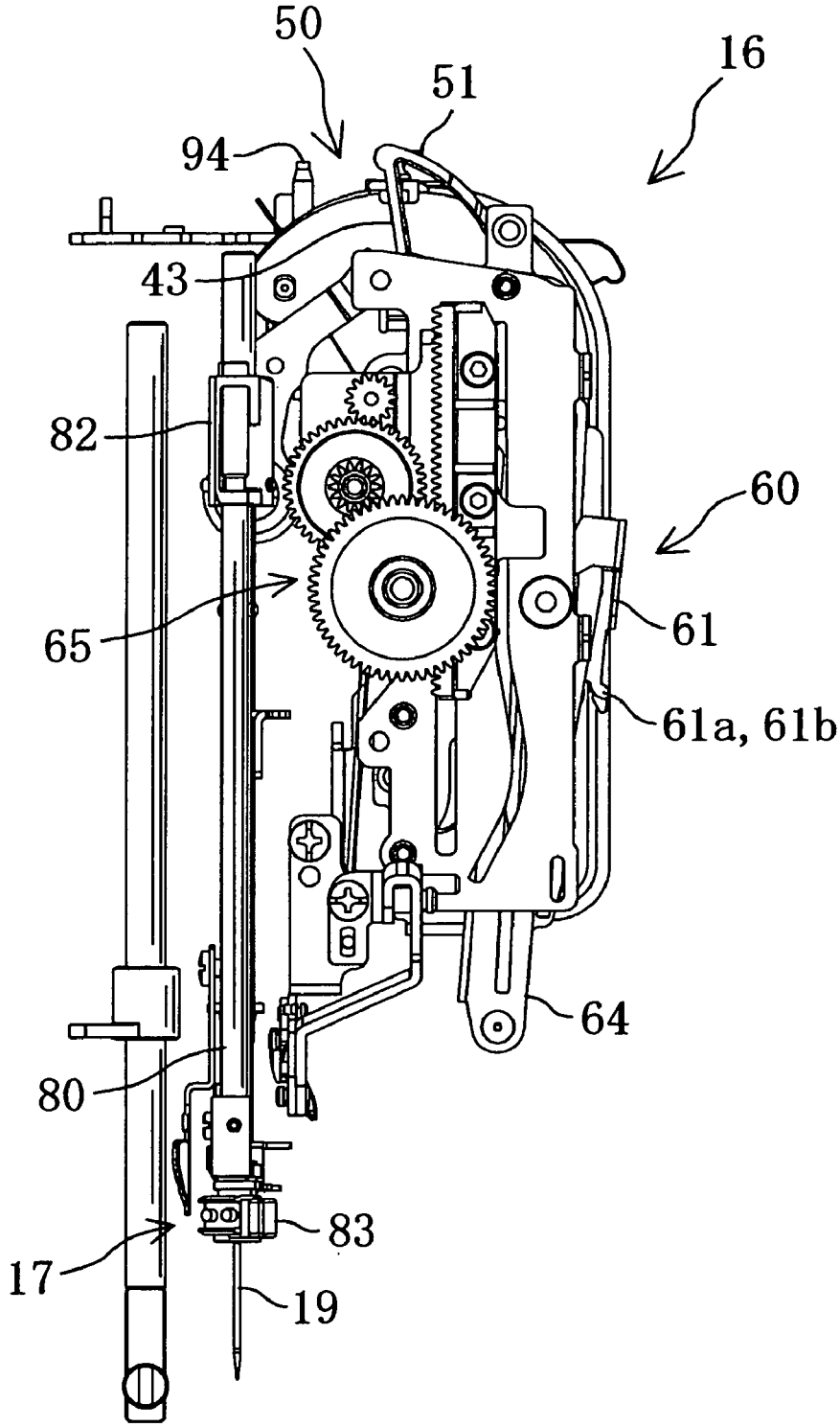
FIG. 21C is a perspective view of the automatic threading device and the automatic needle threading device (in thread take-up threading state)
Figure 21D:
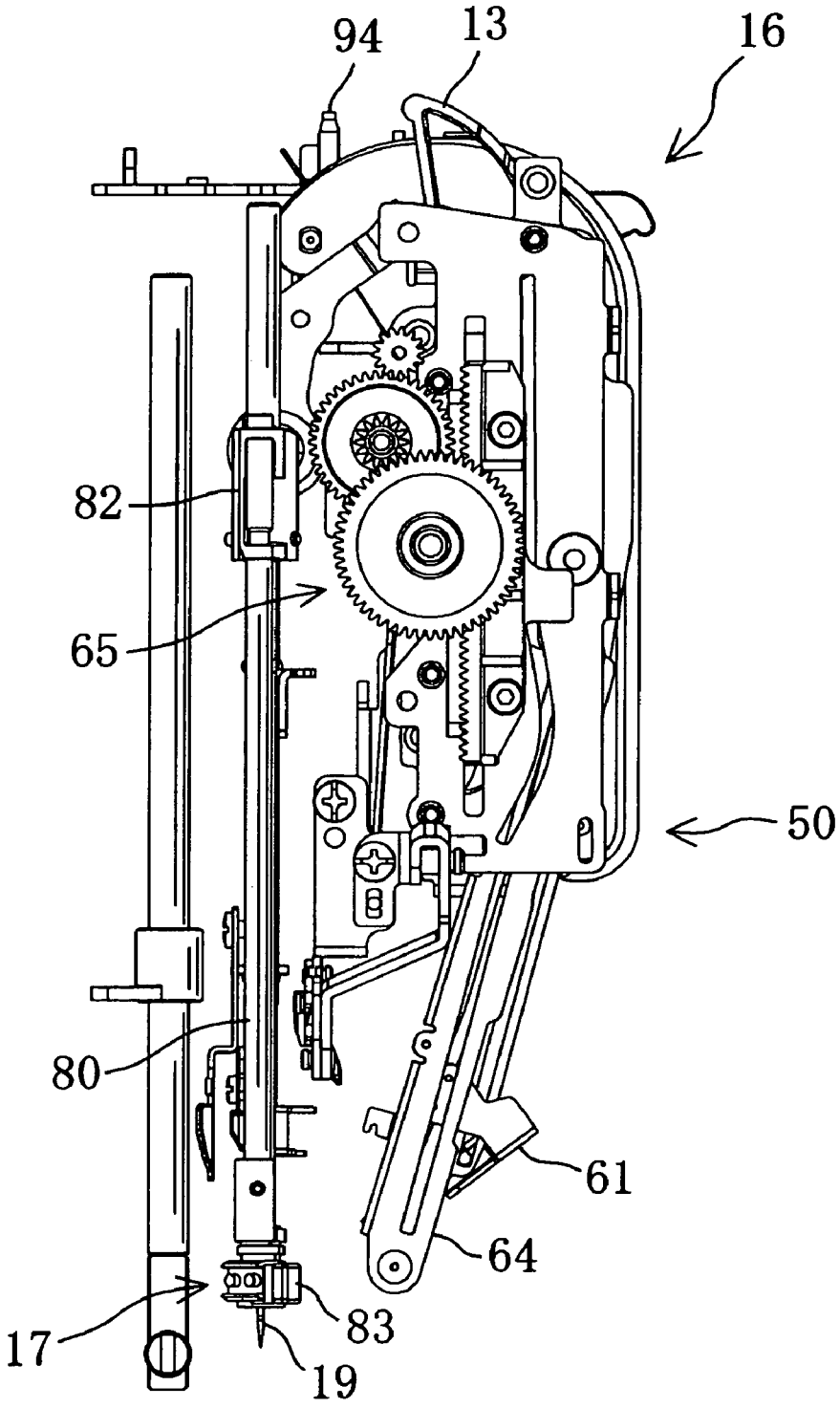
FIG. 21D is a perspective view of the automatic threading device and the automatic needle threading device (in check spring threading state)

Referring to FIGS. 19A, 20A, and 21A, the standby position of the first thread carrier member 51 is located in the rear side of the upper end portion of the first guide frame 52. Referring to FIGS. 19D, 20D, and 21D, the thread transfer position of the first thread carrier member 51 is located in the rear side of the lower end portion of the first guide frame 52. The first thread carrier member 51 moves between the standby position and the thread transfer position by moving along the upper end edge, the front end edge, and the lower end edge of the first guide frame 52. The threading portion of the first thread carrier member 51 faces the surface of the strip cover 35*g*. The foot of the first thread carrier member 51 is engaged with the edges of the first guide frame 52 so as to be supported and movably guided thereby.

When the first thread carrier member 51 moves from the standby position to the thread transfer position, the first thread carrier member 51 catches and downwardly carries the needle thread 10 set in the first threading route 30. Then, the first thread carrier member 51 threads the thread tension regulator 14 with the needle thread 10 disposed in the upper stream relative to the first thread carrier member 51. Then, after the first thread carrier member 51 reaches the thread transfer position, the first thread carrier member 51 carries the needle thread 10 from the front side of the lower end of the first guide frame 52 to the rear side thereof. Then the needle thread 10 being pulled by the second thread carrier member 61 is introduced into the notch 52*a* from the first guide frame 52 lower end and threads the check spring 15.

Though not shown, the first drive mechanism includes an endless wire to which the first thread carrier member 51 is connected, and a plurality of guide rollers for attaching a part of the wire to the first guide frame 52 so as to be disposed along the upper end edge, the front end edge, and the lower end edge thereof. The drive of the first pulse motor 54 pulls the wire, consequently driving the first thread carrier member 51 between the standby position and the thread transfer position.

A thread tension mechanism 55 employing a thread tension regulator 14 will be described in detail hereinafter. Referring to FIG. 11, the thread tension mechanism 55 includes a pair of thread tension discs 14*a* and 14*b* that applies tension to the needle thread 10 by clamping the needle thread 10 therebetween; a spring member (not shown) that presses the thread tension discs 14*a* and 14*b*; an adjustment mechanism (not shown) that makes variable adjustments of the spring force exerted by the spring member; and a thread tension pulse motor 57 that operates the adjustment mechanism. The adjustment mechanism is driven by the thread tension pulse motor 57 such that the thread tension discs 14*a* and 14*b* are pressed against one another during the sewing operation and separated from one another during the threading operation.

Figure 19E:
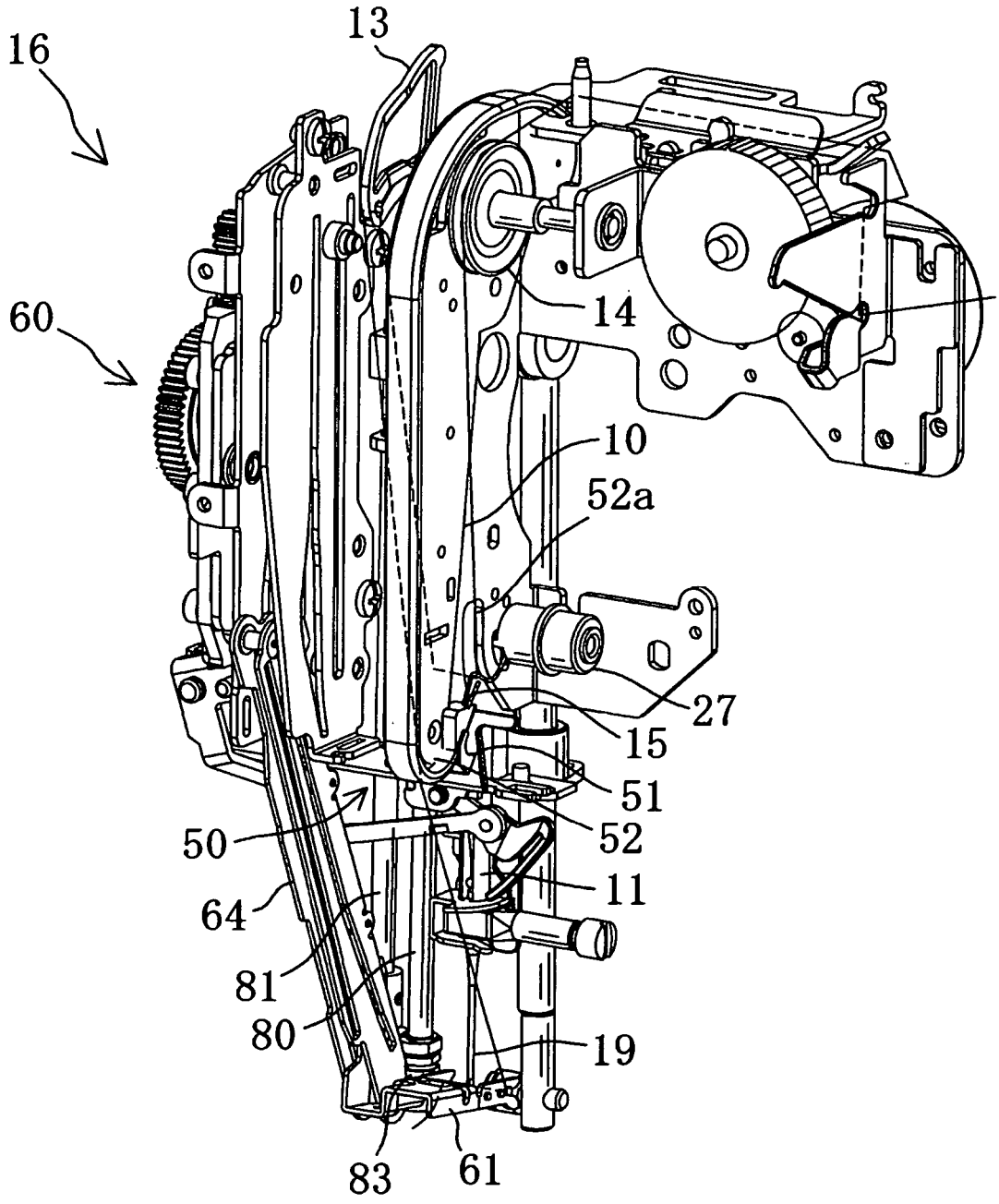
FIG. 19E is a perspective view of the automatic threading device and the automatic needle threading device (in thread transfer state)
Figure 20E:
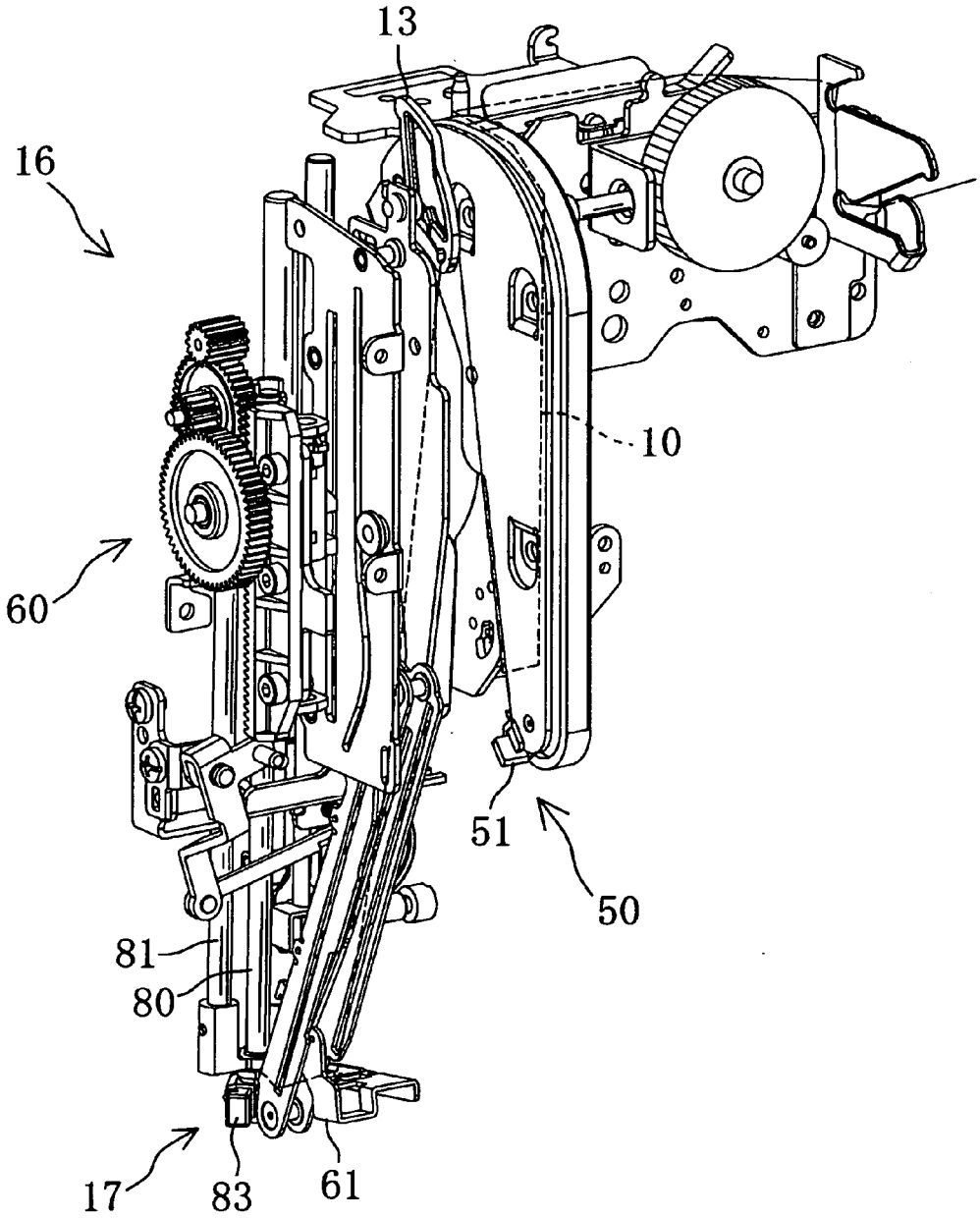
FIG. 20E is a perspective view of the automatic threading device and the automatic needle threading device (in thread transfer state)
Figure 21E:
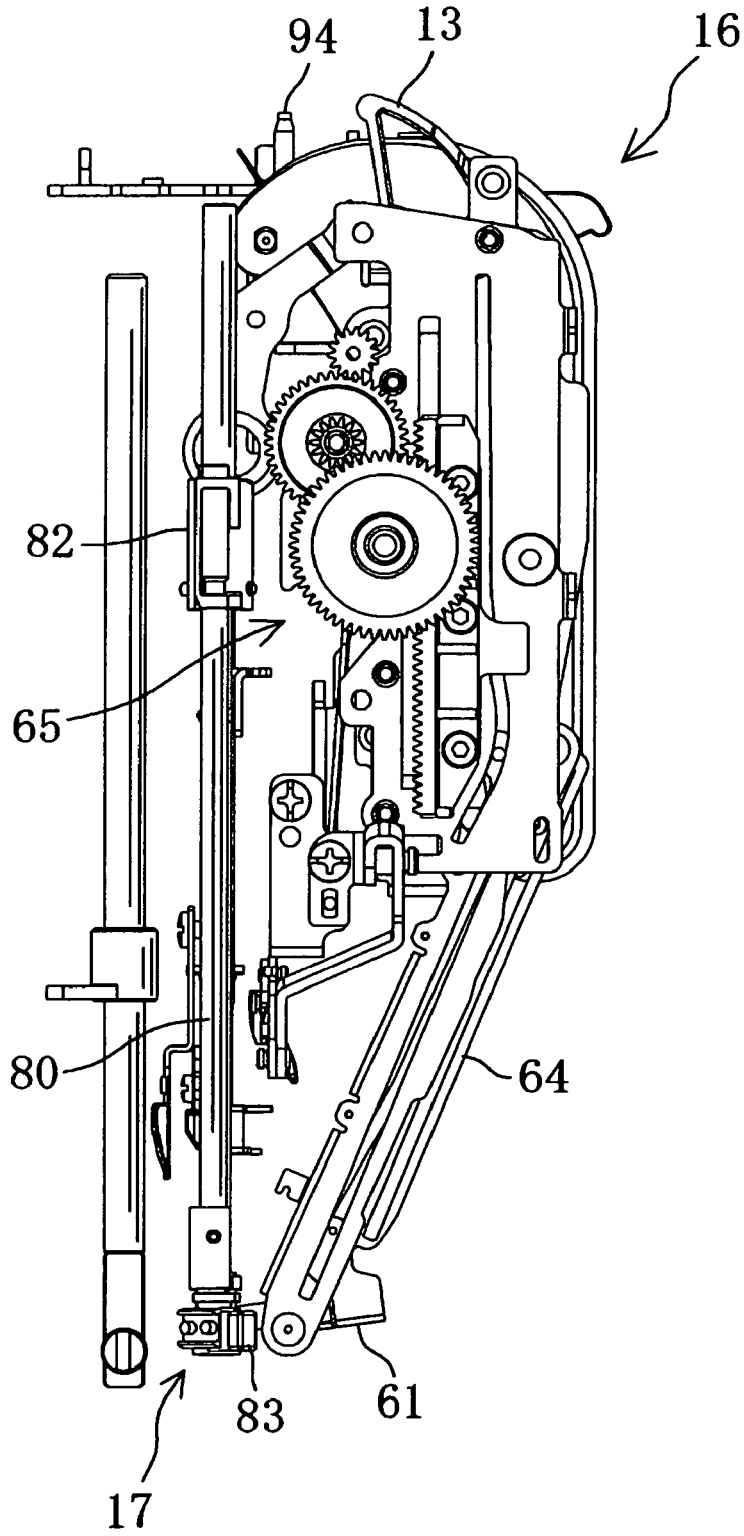
FIG. 21E is a perspective view of the automatic threading device and the automatic needle threading device (in thread transfer state)

Referring to FIGS. 11 and 12, the second thread carrier member 60 includes two second guide frames 62 and 63 disposed laterally relative to each other that are affixed to the sewing machine frame; a movable frame 64 guided and supported by the second guide frames 62 and 63 and also movable between the retracted position shown in FIGS. 19A, 20A, and 21A and the projecting position shown in FIGS. 19E, 20E, and 21E; a second thread carrier member 61 guided and supported by the movable frame 64 and also movable between the standby position shown in FIGS. 19A, 20A, and 21A and the thread transfer position shown in FIGS. 19E, 20E and 21E, the movement of which being induced by the movable frame 64; and a second drive mechanism 65 that drives the movable frame 64 and the second thread carrier member 61 respectively.

The second guide frames 62 and 63 are disposed in the left side of the needle bar 11 and the thread take-up 13 and takes on a vertically elongated plate-form having laterally oriented faces. The second guide frames 62 and 63 are disposed so as to confront one another with a predetermined space defined therebetween. The movable frame 64 comprises a laterally disposed pair of elongate movable pieces that are linked so as to confront one another. The legs of the second thread carrier member 61 are inserted therebetween.

Guide grooves 62*a* and 63*a* by which the movable frame 64 is guided are defined in the second guide frames 62 and 63 respectively. Also, guide grooves 64*a* are respectively defined in the pair of the movable pieces of the movable frame 64 by which the second thread carrier member 61 is guided.

Referring to FIGS. 19A, 20A, and 21A, the second thread carrier member 61 assumes a downward disposition when in the standby position located immediately in front of and below the thread take-up 13. The second thread carrier member 61 assumes a reward disposition as shown in FIG. 19E, 20E and 21E when in the thread transfer position located in front of the sewing needle 19. The second thread carrier member 61 has a pair of left and right thread holding portions 61*a* and 61*b* capable of holding the needle thread 10 disposed in the first threading route 30. Each thread holding member 61*a* and 61*b* is in a forked profile and a clamping piece capable of releasably clamping the needle thread 10 is attached to the thread holding member 61*a* in the left side.

When the second thread carrier member 61 moves from the standby position to the thread transfer position, the second thread carrier member 61 holds and downwardly carries the needle thread 10 set in the first threading route 30. When the second thread carrier member 61 reaches the thread transfer position, the needle thread 10 is held in a laterally stretched manner in front of the eye 19*a* of the sewing needle 19 by the second thread carrier member 61.

Referring to FIG. 12, the second drive mechanism 65 includes a drive gear 66, double shift gears 67*a* and 67*b*, and a rack forming member 68 which are disposed in the left side of the second guide frame 62 along with the second pulse motor 69. The second pulse motor 69 is affixed to the sewing machine frame and has a drive gear 66 connected to the output shaft thereof.

The double shift gears 67*a* and 67*b* are supported rotatably by the sewing machine frame. The drive gear 66 is in mesh engagement with the large-diameter gear of the double shift gear 67*a*, and a small-diameter gear of the double shift gear 67*a* is in mesh engagement with the large-diameter gear of the double shift gear 67*b*. The rack forming member 68 is guided vertically movably with respect to the second guide frames 62 and 63 and a small-diameter pinion of the double shift gear 67*b* is in mesh engagement with a rack 68*a* of the rack forming member 68.

When the second pulse motor 69 is driven, the drive force is conveyed to the rack forming member 68 via the drive gear 66, the double shift gears 67*a* and 67*b*, and the rack 68*a* so as to vertically drive the rack forming member 68. When the rack forming member 68 is vertically moved, the movable frame 64 linked to the rack forming member 68 via a plurality of pulleys and wires (not shown) is moved approximately twice as fast as the rack forming member 68. The second thread carrier member 61 linked to the movable frame 64 via a plurality of pulleys and wires (not shown) is moved approximately twice as fast as the movable frame 64 (that is, approximately four times faster than the rack forming member 68).

The automatic threading device 16 includes a third thread carrier mechanism 37 and a drive mechanism (not shown) that drives the same. The third thread carrier mechanism 37 has a third thread carrier member 38 formed as a hook that catches the needle thread 10 carried toward the sewing needle 19 by the second thread carrier member 61. Thereafter, the third carrier member 38 carries the needle thread 10 to a needle bar thread guide 18 provided in the needle bar 11 and threads the needle bar thread guide 18 with the needle thread 10. The details of the third thread carrier mechanism 37 will not be given in the present embodiment.

Next, the automatic needle threading device 17 will be described in detail. As shown in FIGS. 11, 12, 19A to 19F, 20A to 20F, and 21A to 21F, the automatic needle threading mechanism 17 includes a vertically elongate needle threading shaft 80 disposed vertically movably in the immediate left side (proximity) of the needle bar 11; a vertically elongate needle threading guide shaft 81 disposed to the immediate left side of the needle threading shaft 80 and vertically movable integrally with the needle threading shaft 80; a needle threading slider 82 fitted in a vertically movable manner on the upper ends of the needle threading shaft 80 and the needle threading guide shaft 81; and a drive mechanism (not shown) that vertically drives the needle threading slider 82. The automatic needle threading device 17 further comprises a hook mechanism 83 having a needle threading hook provided in the lower end of the needle threading shaft 80 and capable of passing through the eye 19*a* of the sewing needle 19; and a rotary mechanism (not shown) that rotates the needle threading shaft 80 in the lower most position thereof so that the needle threading hook of the hook mechanism 83 passes through the eye 19*a* of the sewing needle 19.

The automatic needle threading device 17 operates in synchronism with the second thread carrier mechanism 60 of the automatic threading device 16. The second thread carrier member 61 and the needle threading shaft 80 respectively reach the thread transfer position and the lowermost position substantially at the same time. Then, the needle threading hook of the hook mechanism 83 rotates approximately 90° and passes through the eye 19*a* of the sewing needle 19 to catch the needle thread 10 held by the second thread carrier member 61. Thereafter, the needle threading hook of the hook mechanism 83 rotates back approximately 90° and moves out of the eye 19*a* of the sewing needle 19, consequently threading the eye 19*a* with the needle thread 10. Subsequently, the needle threading shaft 80 and the like are moved back to the original position.

The first threading route 30 and the second threading route 32 will be described in detail hereinafter. As described earlier, the first threading route 30 is a route in which the needle thread 10 drawn from the thread spool 9 is set in standby before sequentially threading the plurality of threading portions (thread tension regulator 14, check spring 15, and the thread take-up 13) by the automatic threading device 16. The needle thread 10 is introduced to the first threading route 30 from tho first thread guide path 31 defined in the sewing machine cover 35.

The second threading route 32 is a route by which the plurality of threading portions is manually threaded sequentially with the needle thread 10 drawn from the thread spool 9. The needle thread 10 is introduced in the second threading route 32 from the second thread guide path 33 defined in the sewing machine cover 35.

Referring to FIGS. 4, 19A, and 20A, a leftward recess 36 is defined in the lower portion of the right end of the thread introducing front cover 35*b* from which the threading members 90 and 91 project to the exterior of the recess 36. A pretensioner 93 in a plate-form capable of pressing the needle thread 10 against a receiving plate 92 with suitable pressure is provided between the first guide frame 52 and the threading member 91 inside the sewing machine cover 35. A threading shaft member 94 projects from the left side of the pretensioner 93. A threading member 95 is provided in a position which can be described as being immediately below the right-side thread holding member 61*b* of the second thread carrier member 61 in the standby position and in the right side of the movement path of the second thread carrier member 61.

Though not shown, the threading member 95 is used to lightly hold the needle thread 10 in a predetermined position in order to be engaged with the thread holding members 61*a* and 61*b* by the movement of the second thread carrier member 61. Also, a threading member 96 is provided that extends in a vertical groove portion of the L-shaped guide path 34*b* provided between the thread introducing left cover 35*d* and the face plate cover 35*f*.

The needle thread 10 set in the first threading route 30 is handled as follows. First, the needle thread 10 drawn leftward from the thread spool 9 is hooked on the threading portion 90 from above, and is subsequently hooked on a lower threading portion 91*a* of the threading portion 91 from the underside. The needle thread 10 extends upward thereafter and engages with an upper projecting threading portion 91*b* from the front side by sequentially contacting the right side and the rear side thereof and thereafter further extends leftward.

Next, the needle thread 10 extending leftward from the upper projecting threading portion 91*b* is passed between the receiving plate 92 and the pretensioner 93. The needle thread 10 thereafter engages with the threading shaft member 94 from the rear side and is subsequently engaged with the thread guide portion 43 of the thread take-up 13 from the rear side. The needle thread 10 disposed between the threading shaft member 94 and the thread guide portion 43 is moved to the proximity of the upper end of the strip cover 35*g* so as to be reliably engaged with the first thread carrier member 51 moving from the standby position to the thread transfer position.

The needle thread 10 engaged with the thread guide portion 43 of the thread take-up 13 extends forwardly downward and is engaged with the threading member 95. The needle thread 10 extends leftward thereafter and is engaged with the lower threading portion 96*a* of the threading member 96. Subsequently, the needle thread 10 extends upward and is held by an upper thread holding portion 96*b* of the threading member 96, whereafter the lower stream end of the needle thread 10 is cut by the cutter 97 mounted on the threading member 96.

The needle thread 10 disposed between the threading members 95 and 96 crosses the movement path of the pair of thread holding members 61*a* and 61*b* of the second thread carrier member 61 moving from the standby position and the thread transfer position and is reliably held thereby.

Next, the operation and effect of the sewing machine M having above described construction will be described hereinafter. By operating the threading standby switch 23, the thread take-up 13 is automatically moved and stopped at the threading position most suitable for threading the thread take-up 13. However, in this case, the presser bar 12 is automatically lowered to the lowermost position so that the needle threading device and the presser foot do not interfere with one another.

Alternatively, a pulley connected to the main shaft may be rotated by manual operation to move the thread take-up 13 to the aforementioned threading position. In this case, in order to reliably position the thread take-up 13 in the threading position, it is preferable to provide a symbol on the pulley and the sewing machine cover 35 near the pulley that indicates the most suitable threading position.

Thus, when automatic threading is started by turning on the thread standby switch 23, the presser foot lifting lever 77 is rotated to the lowered position as shown in FIGS. 13 and 14 due to the presser bar 12 being lowered to the lowered position. Since the presser-foot-lifting interlock lever 109 is consequently rotated clockwise as shown in FIG. 14, the right shutter operating lever 107 is rotated clockwise when viewed in FIG. 13 and the right shutter member 102 slides to the left side position.

At this time, since the slide detection sensor 110 does not detect the sliding of the right shutter member 102 to the right side position, the magnet 121 is inactivated. Thus, the rotary lever 122 is rotated to the unadsorbing position and the left shutter member 113 slides to the left side position via the left shutter operating lever 116. Therefore, the movable thread guide path 34C2 defined by the left and right shutter members is switched to the left side route (refer to FIG. 13).

From this state, the first thread guide path 31 defined in the sewing machine cover 35 is threaded with the needle thread 10 drawn by the thread spool 9 in the sequence of: the guide path 34*a*, guide path 34*b*, guide path 34*c*, and guide path 34*d*. Finally, the needle thread 10 is wound around the threading member 96 from above that is placed in the vertical groove portion of the guide path 34*d* and is held by the upper thread holding portion 96*b*. The lower stream of the needle thread 10 held by the upper thread holding portion 96*b* is thereafter cut by the cutter 97. Thus, the needle thread 10 engaged with the first thread guide path 31 is introduced to the first threading route 30 via the first thread guide path 31 and the needle thread 10 is placed in condition to thread the threading portions.

FIGS. 19A, 20A, and 21A shows the needle thread 10 set to the first threading route 30 being passed along the locus of the first thread carrier member 51 to be engaged with the thread guide portion 43 of the thread take-up 13 from the rear side and passed across the moving path the pair of thread holding members 61*a* and 61*b* of the second thread carrier member 61.

Next, by operating the automatic threading start switch 25, the automatic threading device 16 and the automatic needle threading device are activated and the needle thread 10 set to the first threading route 30 automatically threads the plurality of threading portions such as the thread tension regulator 14, check spring 15 and thread take-up 13 and passes through the eye 19*a* of the sewing needle 19. At this time, the thread tension discs 14*a* and 14*b* of the thread tension regulator 14 are in a released state.

In such case, the first and the second pulse motors 54 and 69 are driven substantially at the same time to drive the first and the second thread carrier mechanisms 50 and 60 respectively so as to move the first and the second thread carrier members 51 and 61 respectively from the standby position to the thread transfer position. Then, as shown in FIGS. 19B, 20B, and 21B, first the needle thread 10 disposed between the threading shaft portion 94 and the thread take-up 13 are caught by the first thread carrier member 51 from above, and the needle thread 10 disposed between the threading portions 95 and 96 are caught by the pair of thread holding portions 61*a* and 61*b* of the second thread carrier member 61 from above and retained thereby.

Thereafter, the first thread carrier member 51 carries the needle thread 10 downward and the second thread carrier member 61 carries the retained needle thread 10 downward. At this time, the needle thread 10 between the thread carrier members 51 and 61 is tensioned as shown in FIGS. 19C, 20C, and 21C.

The tensioned needle thread 10 engaged with the thread guide portion 43 of the thread take-up 13 is guided to the thread introducing portion 42 by the thread guide portion 43 and becomes introduced to the threading portion 41 by the thread introducing portion 42.

Also, the needle thread 10 supplied to the first thread carrier member 51 from the threading shaft member 94 is introduced between the pair of opened thread tension discs 14*a* and 14*b*. Thereafter, the first thread carrier member 51 is moved downward and reaches the thread transfer position located in the rear side of the circumferential lower end portion of the first guide frame 52 as shown in FIGS. 19D, 20D, and 21D. At this time, the needle thread 10 caught by the first thread carrier member 51 extends from the front to the rear side of the lower end portion of the first guide frame 52.

Immediately after the first thread carrier member 51 reaches the thread transfer position, the second thread carrier member 61 reaches the proximity of the thread transfer position and thereafter reaches the thread transfer position at which point, the needle thread 10 in the upper stream relative to the thread transfer position is pulled toward the down stream thereof. That is, as shown in FIGS. 19E, 20E, and 21E, when the second thread carrier member 61 reaches the thread transfer position, the needle thread 10 extending from the front side to the rear side of the first guide frame 52 lower end is pulled upward.

Figure 19F:
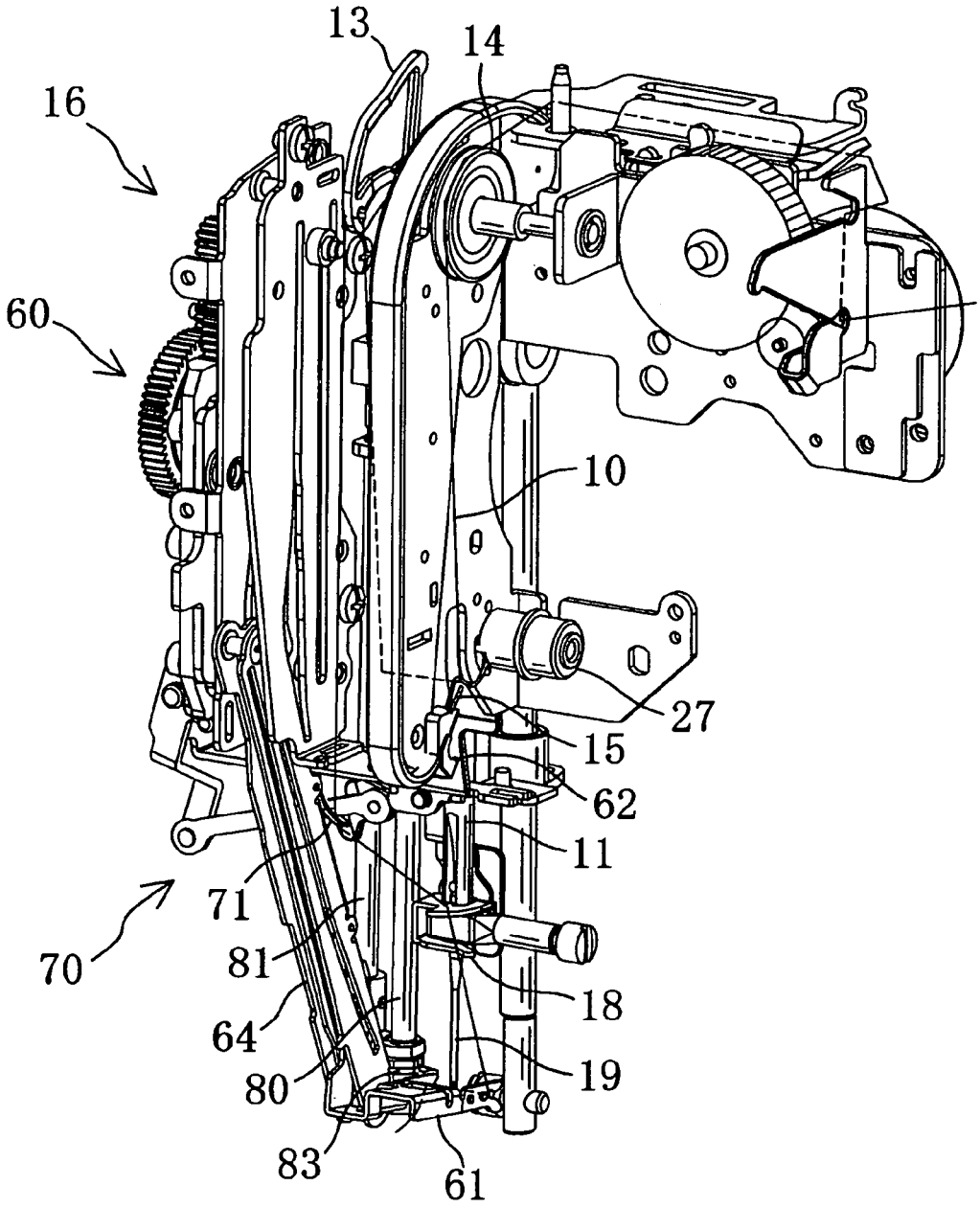
FIG. 19F is a perspective view of the automatic threading device and the automatic needle threading device (in needle bar thread guide threading state)
Figure 20F:
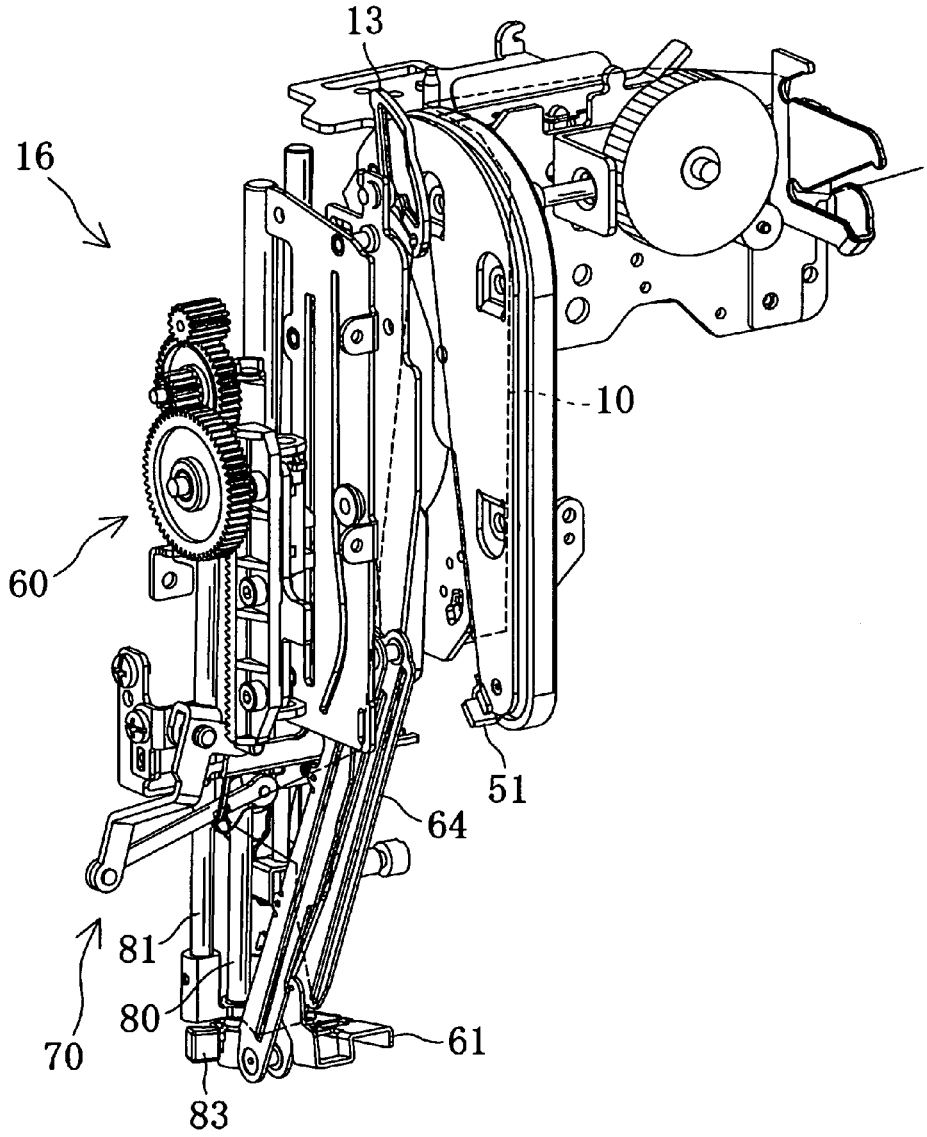
FIG. 20F is a perspective view of the automatic threading device and the automatic needle threading device (in needle bar thread guide threading state)
Figure 21F:
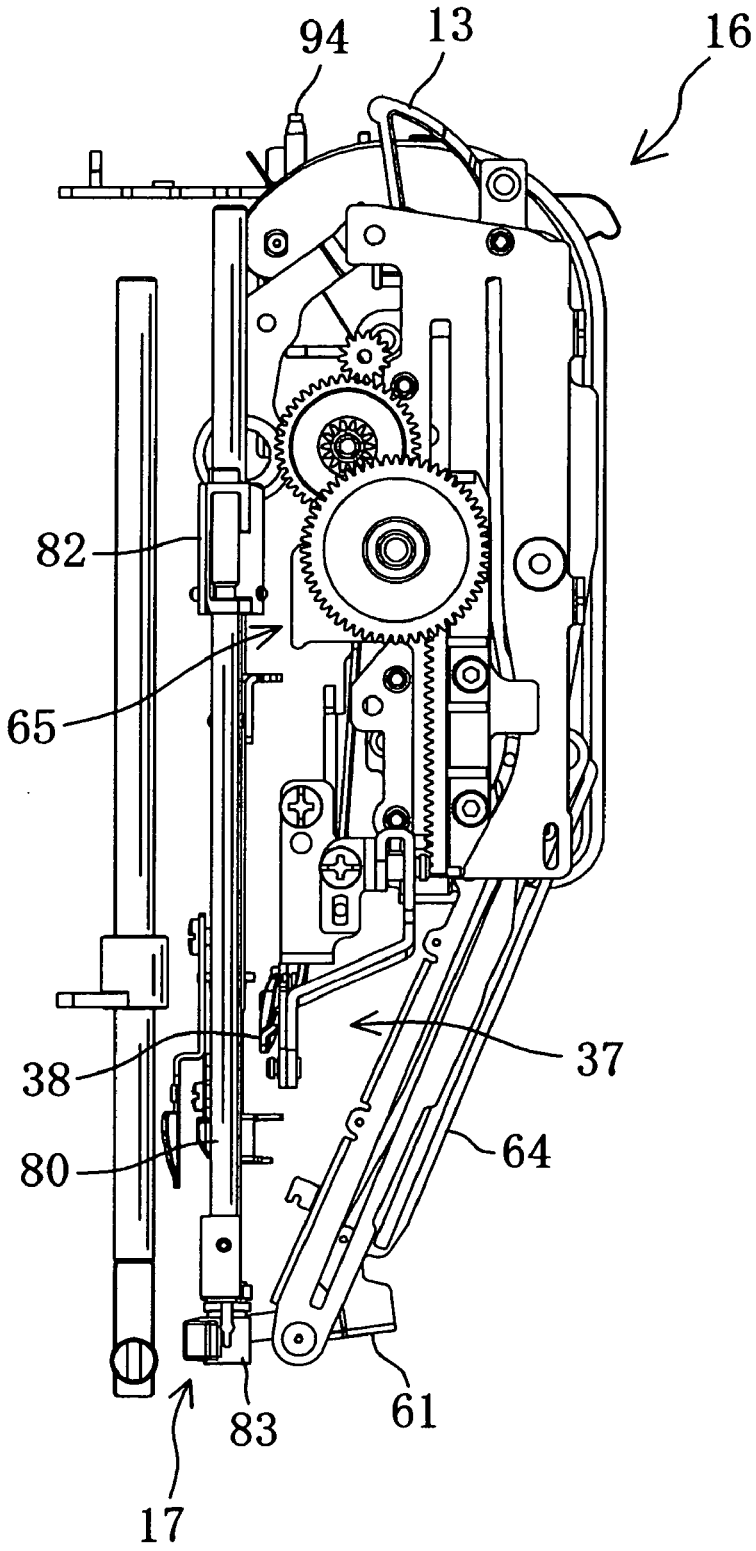
FIG. 21F is a perspective view of the automatic threading device and the automatic needle threading device (in needle bar thread guide threading state).

Thus, the needle thread 10 is introduced to the notch 52*a* and is engaged with the check spring 15. Also, when the second thread carrier member 61 reaches the thread transfer position, the needle thread 10 is held by being laterally stretched in front of the eye 19*a* of the sewing needle 19 by the second thread carrier member 61. Thereafter, as shown in FIGS. 19F, 20F and 21F, the third thread carrier mechanism 37 is activated and the third thread carrier member 38 catches the needle thread 10, which has been carried to the proximity of the sewing needle 19 by the second thread carrier member 61, and carries the needle thread 10 to the needle bar thread guide 18 to engage the needle thread 10 therewith.

The automatic needle threading device 17 is activated substantially at the same time as the automatic threading device 16. As shown in FIGS. 19A to 19F, 20A to 20F, and 21A to 21F, the needle threading shaft 80 and the needle threading guide shaft 81 are lowered integrally with the needle threading slider 82 in synchronism with the descent of the second thread carrier member 61, and the second thread carrier member 61 reaches the thread transfer position.

At this time, the needle threading shaft 80 and the needle threading guide shaft 81 stop descending at the same time, and the needle threading hook of the hook mechanism 83 is disposed in level with the eye 19*a* of the sewing needle 19. Thereafter, further descent of the needle threading slider 82 causes a rotary mechanism of the hook mechanism 83 to rotate the needle threading hook about the vertical shaft center, rendering the threading hook to pass through the eye 19*a* of the sewing needle 19 and catch the needle thread 10 retained by the second thread carrier member 61.

Subsequently, the needle threading hook of the hook mechanism 83 rotates in the reverse direction and moves out of the eye 19*a* of the sewing needle 19, whereby the needle thread 10 is passed through the eye 19*a*. Thereafter, the needle threading slider 82, needle threading shaft 80 and the needle threading guide shaft 81 are lifted to the original position. Also, the first and the second thread carrier members 51 and 61 return to the original position and the sewing machine is placed in condition for carrying out a sewing operation.

Manual threading and manual needle threading operations of the needle thread 10 will be described hereinafter. The thread take-up 13 is automatically moved to the most suitable position for threading the thread take-up 13 by operating the threading standby switch 23. The user may alternatively move the thread take-up 13 to the aforementioned position by rotating the pulley linked to the main shaft. At this time, mince the presser bar 12 is lowered as described earlier, the user is required to lift the presser bar 12 by manually rotating the presser foot lifting lever 77.

Figure 16:
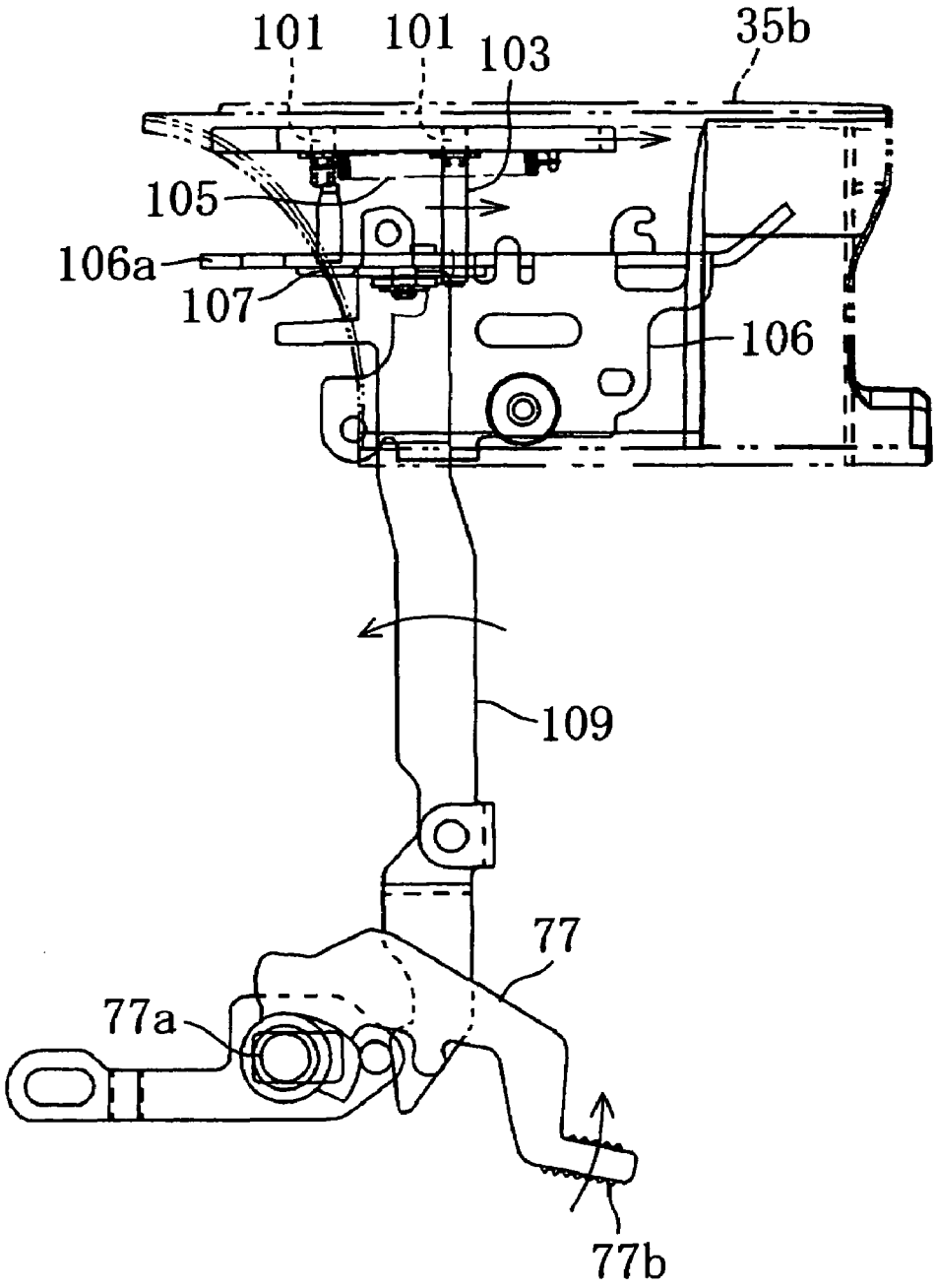
FIG. 16 is a descriptive view of a drive system of a thread introducing front cover and a right shutter member.

Due to the rotation of the presser foot lifting lever 77 to the lifted position as illustrated in FIGS. 15 and 16, the presser-foot-lifting interlock lever 109 is rotated counterclockwise when viewed in FIG. 16, and the right shutter operating lever 107 is rotated counterclockwise when viewed in FIG. 13. As a result, the right shutter member 102 slides to the right side position.

At this time, the slide detection sensor 110 detects the sliding of the right shutter member 102 to the right side position. Thus, the magnet 121 is inactivated whereby the rotary lever 122 is rotated to the adsorbing position, consequently sliding the left shutter member 113 to the right side position via the left shutter operating lever 116. Therefore, the movable thread guide path 34C2 defined between the shutter members 102 and 113 are switched to the right side route (refer to FIGS. 15).

Next, the needle thread 10 drawn from the thread spool 9 is engaged with the second thread guide path 33 by the user in the sequence of the guide path 34*a*, introducing 34*b*, and guide path 34*c*. At this time, threading member 91 and the threading shaft member 94 are sequentially threaded with the needle thread 10 by the user. However, since the movable thread guide path 34C2 is switched to the right side route, the needle thread 10 passes the right side of the thread take-up 13 only threading the thread tension regulator 14 and not the thread take-up 13.

The user subsequently carries the needle thread 10 downward along the strip cover 35*g* to engage the needle thread 10 with the lower end of the first guide frame 52, thereafter turning the needle thread 10 back upward toward the thread take-up 13. The needle thread 10 engaged with the lower end of the first guide frame 52 is pulled upward so as to be introduced to the notch 52*a* and engaged with the check spring 15.

At this time, as described earlier, the check spring sensor 29 outputs a threading signal indicative of the engagement of the needle thread 10 with the check spring 15, and the presser foot lifting pulse motor 73 is driven based on the threading signal. That is, as described earlier, when the presser foot lifting pulse motor 73 is driven, the presser foot lifting lever 77 is rotated to the lowered position and the presser bar 12 is lowered by the descent of the rack forming member 71.

Thus, the right shutter member 102 slides to the left side position via the presser foot lifting lever 77, presser-foot-lifting interlock lever 109, and the right shutter operating lever 107. At the same time, the sliding of the right shutter member 102 to the left side position is detected by the slide detection sensor 110, whereby the magnet 121 is inactivated. Hence, the left shutter member 113 also slides to the left side position via the rotation of the rotary lever 122 and the left shutter operation lever 116. Therefore, the movable thread guide path 34C2 defined by the slit between the shutter members 102 and 113 are switched to the left side position (refer to FIG. 13).

From this state, the needle thread 10 is sequentially engaged with the guide path 34*f* and the guide path 34*g*. When the needle thread 10 is further moved upward to the upper most position of the guide path 34*c*, the needle thread 10 moved upward via the check spring 15 is guided to the rear side of the thread take-up 13 while contacting the release guide portion 44 of the thread take-up 13 from the right side.

Subsequently, when the needle thread 10 is lowered along the guide path 34C, guide path 34*g* and guide path 34*f* by the user, the needle thread 10 extends around the rear side of the first thread lock portion 46 of the thread take-up 13 and proceeds to the left from the left rear ridge (refer to FIG. 9) in front view, and thereafter pulled downward. The needle thread 10 is subsequently locked to the first thread lock portion 46 and thereafter descends along the thread guide portion 43 again to be subsequently guided by the thread introducing portion 42. The needle thread 10 guided by the thread introducing portion is thereafter introduced to the threading portion 41. The needle thread 10 is subsequently engaged with the needle bar thread guide 18 by the user and is passed through the eye 19*a* of the sewing needle 19 to bring the needle thread 10 in condition for the sewing operation.

As described above, according to the sewing machine M, the first thread guide path 31 and the second thread guide path 33 are defined by the plurality of covers 35*a* to 35*g* of the sewing machine M. Also, shutter members 102 and 113 are provided that define the movable thread guide path 34C2 which is switchable between the left side route and the right side route. Further, the switch mechanism 100 is provided that switches the shutter members 102 and 113 to switch the movable thread guide path 34C2 between the left side route and the right side route. Thus, when the shutter members 102 and 113 are switched to the left side position by the switch mechanism 100, since the movable thread guide path 34C2 is switched to the left side route, the needle thread 10 is set to the first threading route 30 by the first thread guide path 31. As a result, at least the thread take-up 13 is automatically threaded with the needle thread 10 when automatic threading device 16 is used.

On the other hand, when the shutter members 102 and 103 are switched to the right side position by the switch mechanism, the movable thread guide path 34C2 is switched to the right side route. Hence, when the second threading route 32 is manually threaded with the needle thread 10 by the second thread guide path 33, the needle thread 10 drawn from the thread spool 9 does not thread the thread take-up 13 but threads the thread tension regulator 14. The plurality of thread hooking portions such as the thread take-up 13 is threaded sequentially thereafter.

To summarize, the plurality of threading portions such as the thread tension regulator 14, check spring 15 and thread take-up 13, can be threaded sequentially, easily and reliably with the needle thread 10 drawn from the thread spool 9 without having to initially engage with the thread take-up 13. Thus, even in case the automatic threading device 16 breaks down, sewing work is not affected since the plurality of threading portions can be manually threaded with the needle thread 10 in the proper threading sequence.

Moreover, automatic threading by the first thread guide path 31 and manual threading by the second thread guide path 33 are clearly differentiated by the disposition of the movable thread guide path 34C2 being switched by the shutter members 102 and 113. Hence, the difference between automatic threading operation and manual threading operation is more visible to the user.

Also, the shutter members 102 and 113 are supported slidably between the left side position and the right side position corresponding to the left side route and the right side route of the movable thread guide path 34C2 respectively. Since the shutter members 102 and 113 are disposed so as to define the movable thread guide path 34C2 which is capable of accommodating the needle thread 10, the right and the left shutter members 102 and 113 can be switched integrally while defining a movable thread guide path 34C2 capable of accommodating the needle thread 10.

Furthermore, the switch member 100 is arranged to slide the right shutter member 102 in response to the operation of the presser foot lifting lever 77. The switch member 100 is also arranged to slide the left shutter member 113 by the magnet 121 based on the detection of the presser foot lifting lever 77 operation. Hence, the right shutter member 102 and the left shutter member 113 can be operated conjunctively by a mere operation of the presser foot lifting lever 77 on the part of the user, which in turn activates the magnet 121 at the same time via the slide detection sensor 110.

Yet, furthermore, the switch mechanism 100 is provided with the check spring sensor 29 that detects a manual threading procedure being triggered by the needle thread 10 passing through the movable thread guide path 34C2 assuming the right side route. The presser-foot-lifting interlock lever 109, the right shutter operating lever 107 and the magnet 121 are driven so as to slide the shutter members 102 and 113 from the right side position to the left side position based on the detection of the check spring sensor 29. Hence, when the needle thread 10 is manually passed through the movable thread guide path 34C2 assuming the right side route, the movable thread guide path 34C2 is automatically switched to the left side route. The automatic switching of the movable thread guide path 34C2 is enabled in this manner.

The present embodiment may be partially modified as follows.

The start of the manual threading procedure may be detected by a thread detection sensor provided below the shutter members 102 and 113 instead of the check spring sensor 29.

The shutter members 102 and 113 may be arranged to rotate or flip-up instead of sliding.

Two separate thread guide paths may be defined for the automatic threading procedure and the manual threading procedure respectively. In such case, either of the two thread guide paths may be blocked by a single slidable plate; or a plurality of light emitting diodes may be provided to direct the intended threading route by way of illumination.

The foregoing description and drawings are merely illustrative of the principles of the present invention and are not to be construed in a limited sense. Various changes and modifications will become apparent to those of ordinary skill in the art. All such changes and modifications are seen to fall within the scope of the invention as defined by the appended claims.

I claim:

1. A sewing machine comprising:

a vertically reciprocable needle bar;

a vertically oscillatable thread take-up;

a thread source supplying a needle thread to a sewing needle attached to the needle bar;

an automatic threading device that automatically threads at least one of a plurality of threading portions including the thread take-up with the needle thread drawn from the thread source;

a first thread guide path for a first threading route that enables threading of the needle thread drawn from the thread source by the automatic threading device;

a second thread guide path for a second threading route that enables manual threading of the plurality of threading portions with the needle thread drawn from the thread source;

a movable member that forms a movable thread guide path switchable between a first position and a second position, the first position defining the movable thread guide path for a part of the first threading route that enables threading of the thread take-up and the second position defining the movable thread guide path for a part of the second threading route that disables threading of the thread take-up; and a switch mechanism that switches the movable member so as to switch the movable thread guide path between the first position and the second position.

2. The sewing machine according to claim 1, wherein the movable member comprises a first movable member and a second movable member, each being supported slidably between a first-position corresponding position that corresponds to the first position and a second-position corresponding position that corresponds to the second position so as to switch the movable thread guide path between the first position and the second position and wherein the first and second movable members are disposed so as to define the movable thread guide path capable of receiving the needle thread.

3. The sewing machine according to claim 2, wherein the switch mechanism comprises a first drive unit that drives a sliding movement of the first movable member, a first detecting unit that detects the movement of the first movable member and a second drive unit that drives a sliding movement of the second movable member based on the detection made by the first detection unit.

4. The sewing machine according to claim 3, wherein the switch mechanism further comprises a second detection unit that detects a start of manual threading triggered by the needle thread passing through the movable thread guide path located in the second position, wherein the first and the second drive units are driven so that the first and the second movable members slide between the second-position corresponding position and the first-position corresponding position based on the detection made by the second detection unit.

5. The sewing machine according to claim 3, wherein the first drive unit drives the sliding movement of the first movable member in conjunction with a lifting operation of a presser foot lifting lever that vertically moves a presser bar.

6. The sewing machine according to claim 4, wherein the first drive unit drives the sliding movement of the first movable member in conjunction with a lifting operation of a presser foot lifting lever that vertically moves a presser bar.

7. The sewing machine according to claim 3, wherein the second drive unit comprises an electrical actuator.

8. The sewing machine according to claim 4, wherein the second drive unit comprises an electrical actuator.

* * * * *